US010024049B2

(12) United States Patent
Brekke et al.

(10) Patent No.: US 10,024,049 B2
(45) Date of Patent: Jul. 17, 2018

(54) HANGER FOR FIRE SEPARATION WALL

(71) Applicant: Columbia Insurance Company, Omaha, NE (US)

(72) Inventors: Steven Brekke, Lakeville, MN (US); Mark R. Rolf, Fredericksburg, VA (US)

(73) Assignee: Columbia Insurance Company, Omaha, NE (US)

( * ) Notice: Subject to any disclaimer, the term of this patent is extended or adjusted under 35 U.S.C. 154(b) by 43 days.

(21) Appl. No.: 14/555,049

(22) Filed: Nov. 26, 2014

(65) Prior Publication Data

US 2015/0184370 A1 Jul. 2, 2015

Related U.S. Application Data

(60) Provisional application No. 61/922,531, filed on Dec. 31, 2013.

(51) Int. Cl.
*E04B 1/26* (2006.01)
*E04B 1/38* (2006.01)

(52) U.S. Cl.
CPC ..... *E04B 1/2612* (2013.01)

(58) Field of Classification Search
CPC ..... E04B 1/2612; E04B 2001/2644; E04B 2001/2652; E04B 2001/2676; B21D 53/56
USPC ..... 403/230, 231, 232.1; 52/708, 702, 289; 248/300
See application file for complete search history.

(56) References Cited

U.S. PATENT DOCUMENTS 414,169 A * 10/1889 Reuschel ..... E04B 1/2612 248/300
478,163 A * 7/1892 Lehman ..... F16B 7/0446 29/897.3
537,504 A * 4/1895 Van Dorn ..... F16B 7/0446 403/190
546,147 A * 9/1895 Gregg ..... E04B 1/2612 182/87
598,135 A * 2/1898 Butz ..... E04B 1/2612 403/232.1
625,427 A * 5/1899 Stewart et al. ..... F16B 7/0446 182/87

(Continued)

FOREIGN PATENT DOCUMENTS

WO 2012060863 A2 5/2012
WO 2013126987 A1 9/2013

OTHER PUBLICATIONS

Installer's Pocket Guide, Simpson Strong-Tie Company Inc. (2009), 60 pages.

(Continued)

*Primary Examiner* — Joshua J Michener
*Assistant Examiner* — Keith Minter
(74) *Attorney, Agent, or Firm* — Senniger Powers LLP

(57) ABSTRACT

A hanger for connecting a structural component to a wall that can have sheathing mounted thereon either before or after the hanger is connected to the wall. The hanger includes a channel-shaped portion configured to receive the structural component. An extension portion extends from the channel-shaped portion and is configured to extend through the sheathing to engage the wall at a first location. A connection portion is configured for attachment to the wall at a second location spaced from the first location.

13 Claims, 43 Drawing Sheets

(56) References Cited

U.S. PATENT DOCUMENTS 666,918 A * 1/1901 Butz ..... F16B 7/0446 248/300
717,316 A * 12/1902 Avery ..... A47C 23/062 248/239
753,053 A * 2/1904 Eberhardt ..... F16B 7/0446 403/190
770,050 A * 9/1904 Dreyer ..... F16B 7/0446 248/300
783,807 A * 2/1905 Tuteur ..... E04B 1/2612 403/232.1
796,433 A * 8/1905 Kahn ..... F16B 7/0446 182/87
804,451 A * 11/1905 Carlson ..... E04B 1/2612 403/190
828,488 A * 8/1906 Lanz ..... B21D 53/00 29/897.3
874,514 A * 12/1907 Lindow ..... F16B 7/0446 403/190
922,215 A * 5/1909 Tuteur ..... F16B 7/0446 403/190
924,842 A * 6/1909 Seipp ..... F16B 7/0446 403/190
943,847 A * 12/1909 Seipp ..... F16B 7/0446 403/190
1,406,723 A * 2/1922 Caldwell ..... E04B 1/2608 403/232.1
1,728,981 A * 9/1929 Ropp ..... E04B 1/2612 52/702
3,125,785 A * 3/1964 Conville ..... E04B 2/80 52/238.1
3,907,445 A * 9/1975 Wendt ..... E04B 1/2612 403/191
3,945,741 A * 3/1976 Wendt ..... E04B 1/5818 403/191
3,972,169 A 8/1976 Sheppard, Jr.
4,005,942 A 2/1977 Gilb
4,198,175 A * 4/1980 Knepp ..... F16B 15/0046 403/191
4,223,866 A * 9/1980 Black ..... E04G 17/18 249/211
4,230,416 A * 10/1980 Gilb ..... E04B 1/2612 248/300
4,261,155 A * 4/1981 Gilb ..... E04B 1/2612 248/282.1
4,353,664 A * 10/1982 Gilb ..... E04B 1/2612 403/232.1
4,411,548 A * 10/1983 Tschan ..... E04B 1/2612 403/232.1
4,422,792 A * 12/1983 Gilb ..... E04B 1/2612 403/232.1
4,472,916 A * 9/1984 Krebs ..... E04B 1/18 403/174
4,560,301 A * 12/1985 Gilb ..... B21D 53/38 403/232.1
4,584,813 A * 4/1986 Hudson ..... E04B 1/2612 248/214
4,594,017 A * 6/1986 Hills ..... E04B 1/2612 403/232.1
4,665,672 A * 5/1987 Commins ..... E04B 1/0007 403/190
4,920,725 A * 5/1990 Gore ..... E04B 1/2612 403/232.1
5,104,252 A * 4/1992 Colonias ..... E04B 1/2612 403/230
5,111,632 A 5/1992 Turner
5,160,211 A * 11/1992 Gilb ..... E04F 11/181 256/65.02
5,230,198 A * 7/1993 Callies ..... E04B 1/2608 403/232.1
5,249,404 A * 10/1993 Leek ..... E04B 1/0007 182/87
5,341,619 A * 8/1994 Dunagan ..... E04B 1/2612 248/300
5,457,928 A * 10/1995 Sahnazarian ..... E04B 1/2612 403/232.1
5,555,694 A * 9/1996 Commins ..... E04B 1/2612 248/300
5,564,248 A * 10/1996 Callies ..... E04B 1/2612 403/232.1
5,603,580 A * 2/1997 Leek ..... E04B 1/2612 403/168
5,697,725 A * 12/1997 Ballash ..... E04B 1/2608 403/231
5,797,694 A * 8/1998 Breivik ..... E04B 1/2608 403/231
5,896,721 A * 4/1999 Sugiyama ..... E04B 1/2604 403/232.1
6,131,358 A * 10/2000 Wise ..... E04B 1/2612 52/289
6,230,466 B1 5/2001 Pryor
6,463,711 B1 * 10/2002 Callies ..... E04B 1/2612 403/232.1
6,877,291 B2 * 4/2005 Shamroukh ..... E04B 7/022 403/232.1
7,316,098 B1 1/2008 Sackett
7,707,785 B2 * 5/2010 Lin ..... E04B 7/045 52/289
7,971,410 B2 * 7/2011 Jerke ..... E04H 9/14 52/702
8,387,333 B2 3/2013 Brekke
8,677,718 B2 3/2014 Marshall
8,720,155 B1 5/2014 Robell
9,206,594 B1 * 12/2015 Grevious ..... F16B 5/0614
2002/0078656 A1 * 6/2002 Leek ..... E04B 1/2612 52/702
2004/0096269 A1 * 5/2004 Shahnazarian ..... E04B 1/2612 403/232.1
2004/0129845 A1 * 7/2004 Whale ..... E04B 1/2612 248/201
2005/0120669 A1 6/2005 Harrison
2006/0081743 A1 4/2006 Evans et al.
2006/0156682 A1 7/2006 McAndrew et al.
2006/0191233 A1 8/2006 Tamlyn
2007/0119108 A1 * 5/2007 Downard ..... E04B 1/2604 52/289
2007/0294979 A1 12/2007 Lin et al.
2008/0101855 A1 * 5/2008 Lin ..... E04B 1/2612 403/232.1
2008/0237421 A1 10/2008 Szpotowski
2009/0113839 A1 5/2009 Carr
2010/0031601 A1 2/2010 Lin
2011/0146173 A1 6/2011 Visser
2012/0222382 A1 * 9/2012 Brekke ..... E04B 1/2612 52/702
2012/0297724 A1 11/2012 Pope et al.
2013/0067850 A1 3/2013 Sasanecki
2013/0232758 A1 * 9/2013 Pond ..... F16B 17/00 29/428
2014/0338282 A1 11/2014 Sidhu
2015/0167291 A1 * 6/2015 Bundy ..... E04B 1/2612 52/702
2015/0218832 A1 8/2015 Peters et al.
2017/0321418 A1 * 11/2017 Tremblay ..... E04B 1/944

OTHER PUBLICATIONS

Top-Flange Joist Hangers Installed on Walls Over Wood Structural Panel Sheathing or Drywall, Technical Bulletin, Simpson Strong-Tie Company, Inc. (2013), 2 pages.
S/LBV / S/B and S/BA Hangers, Simpson Strong-Tie Company Inc. (2010), 1 page.
Cold-Formed Steel Connectors for Residential and Mid-Rise Construction (C-CFS10), Simpson Strong-Tie Company Inc. (2010), 76 pages.
Wood Construction Connectors Catalog 2013-2014 (C-2013), Simpson Strong-Tie Company Inc., 236 pages.

(56) References Cited

OTHER PUBLICATIONS

Office action dated Oct. 26, 2017, U.S. Appl. No. 15/230,926, filed Aug. 8, 2016, 14 pages.
Non-Final Office action, U.S. Appl. No. 15/675,409, dated Jan. 12, 2018, 20 pages.

* cited by examiner

HANGER FOR FIRE SEPARATION WALL

FIELD OF THE INVENTION

The present invention generally relates to connections for structures, and more specifically, a truss hanger for connecting a truss to a wall including fire retardant sheathing.

BACKGROUND

The use of fire separation walls in structures, such as in multifamily housing, is commonplace. Often, fire separation is required to be continuous along the walls between adjoining units to prevent fire from spreading between the adjoining units in a multifamily structure. For some types of construction, the building codes also require exterior walls to be fire rated. Typically, gypsum board is used as a fire retardant sheathing along these walls. Floor trusses or joists are attached to or hung from the walls including the gypsum board, but cannot be hung from the gypsum board itself. The trusses or joists must therefore be attached to the wall framing. A cutout for the entire cross section of the truss leaves a large discontinuity in the fire retardant sheathing. However, building codes require that the fire separation wall maintain a certain fire resistant rating. Thus, the integrity of the fire retardant sheathing should be maintained and interruptions of the sheathing kept to a minimum.

SUMMARY

In one aspect of the present invention, a hanger for connecting a structural component to a wall having sheathing mounted thereon includes a channel-shaped portion configured to receive the structural component. An extension portion extends from the channel-shaped portion and is configured to extend through the sheathing to engage the wall at a first location. A connection portion is configured for attachment to the wall at a second location spaced from the first location.

In another aspect of the present invention, a truss hanger for connecting a truss to a wall having fire resistant sheathing mounted thereon includes a channel-shaped portion configured to receive the truss. The channel-shaped portion includes a base sized and shaped for receiving a truss chord of the truss thereon, side panels extending upward from the base, and back panels. Each back panel extends from a respective one of the side panels. An extension portion extends from the channel-shaped portion and is configured to extend through the fire resistant sheathing. The extension portion includes extension flanges and back flanges. Each of the extension flanges extends from a respective one of the back panels. Each of the back flanges extends from a respective one of the extension flanges. The truss hanger also includes a connection portion configured for attachment to the wall.

A hanger for connecting a structural component to a wall having sheathing mounted thereon generally comprises a channel-shaped portion configured to receive the structural component. An extension portion is configured to be disposed at least partially in the sheathing. A connection portion is configured for attachment to the wall.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
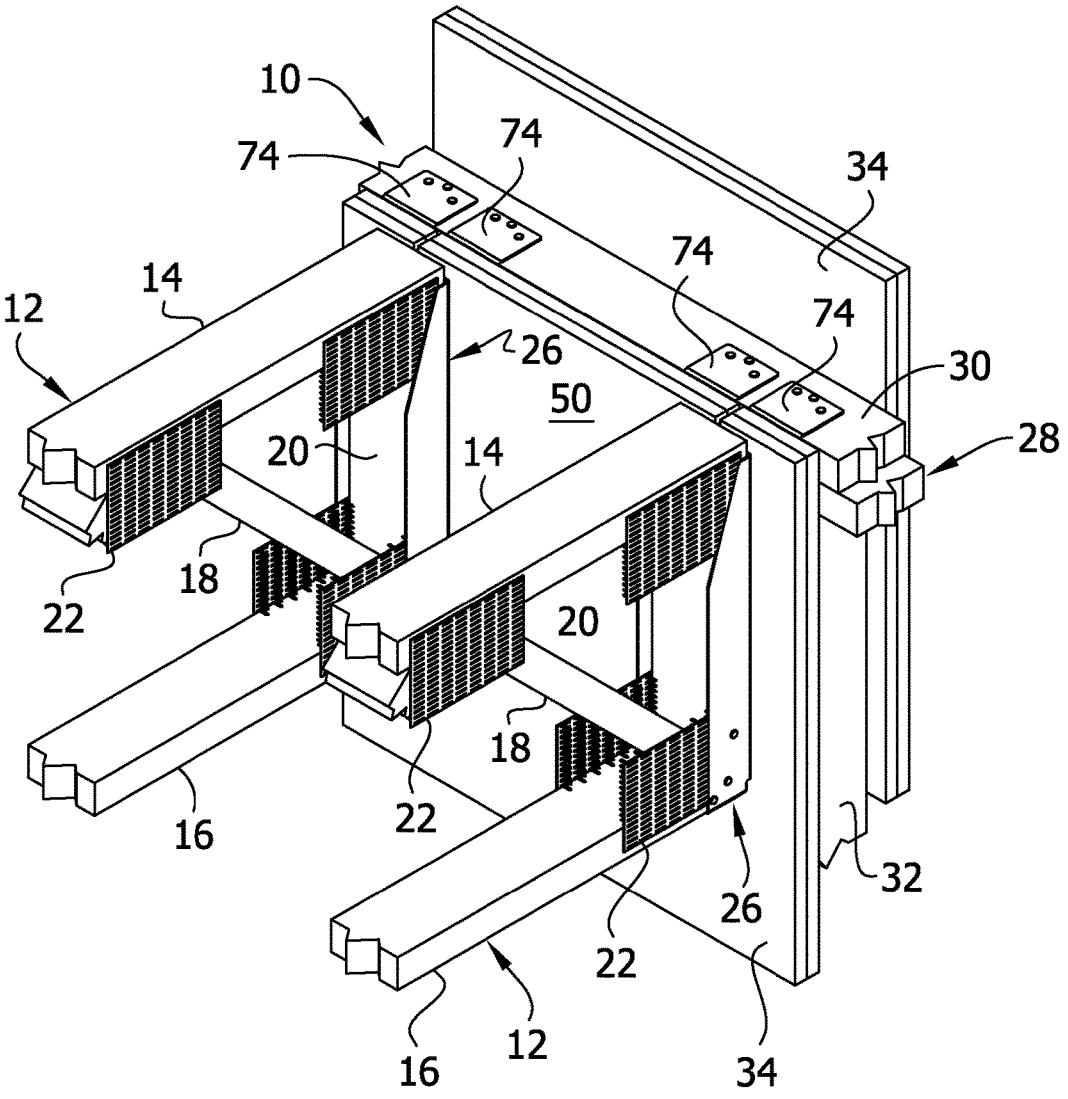
FIG. 1 is a fragmentary perspective of adjacent floor trusses connected to a wall having fire retardant sheathing by truss hangers that extend through the sheathing.
Figure 2:
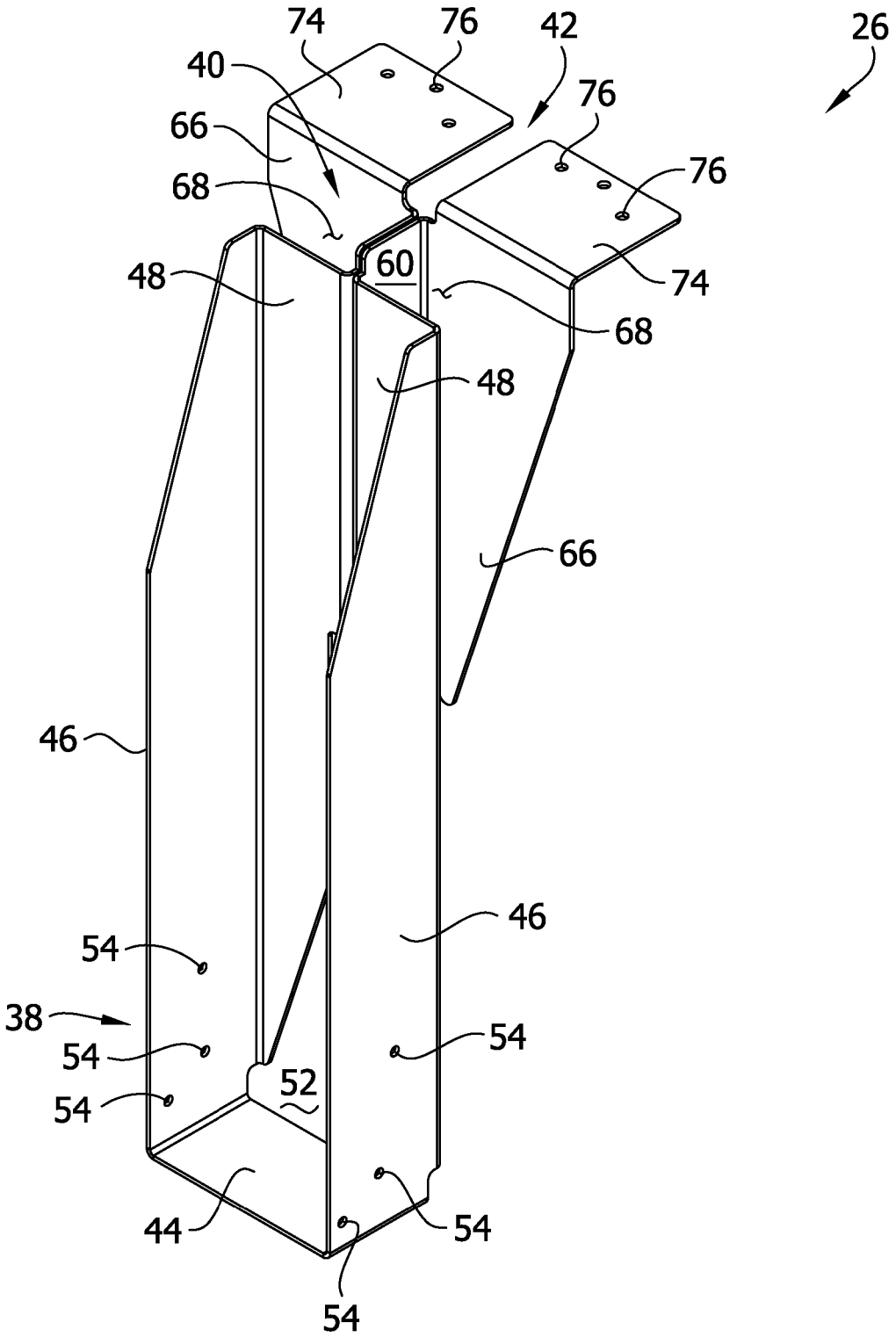
FIG. 2 is a perspective of a truss hanger according to a first embodiment of the present invention.
Figure 2A:
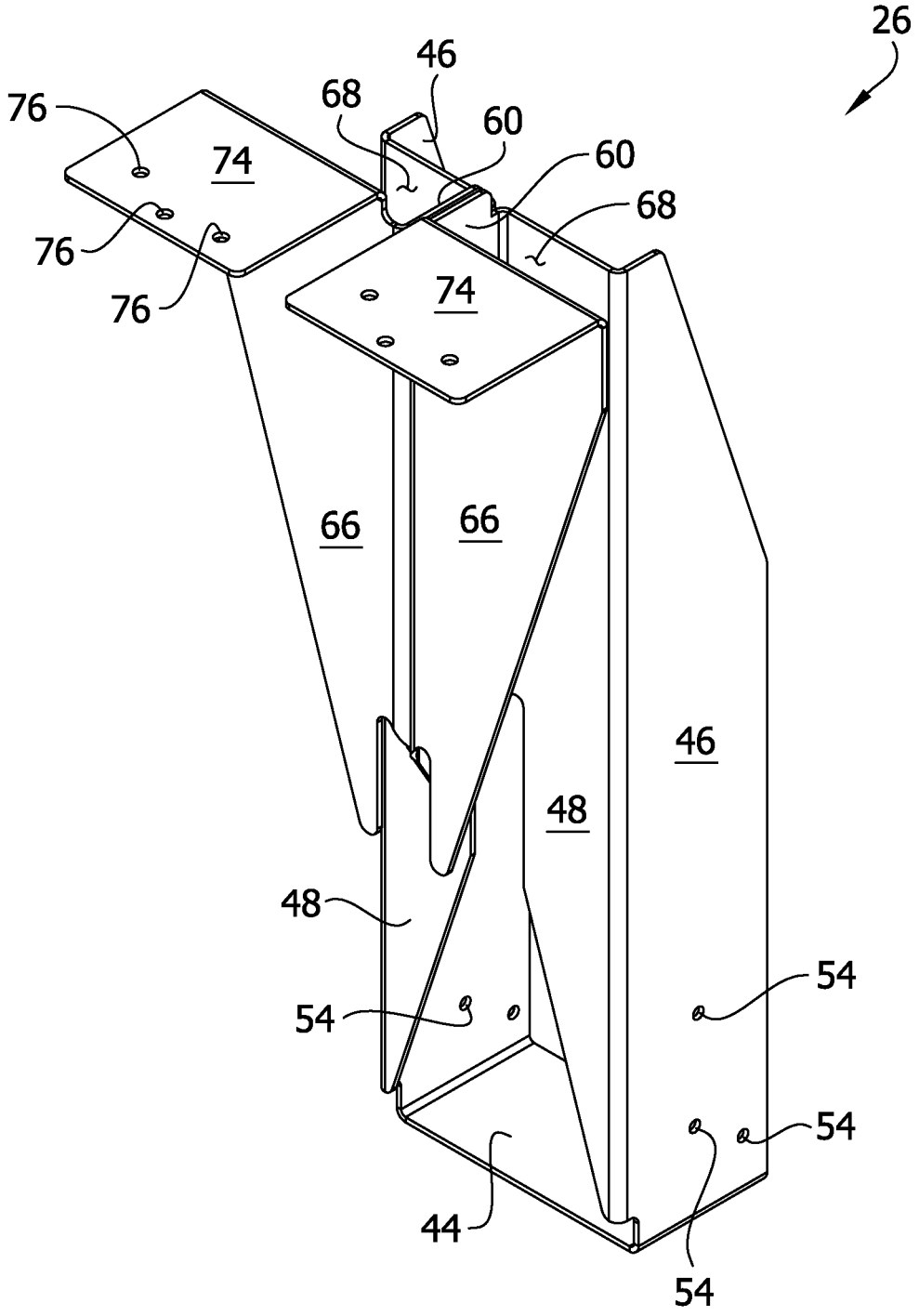
FIG. 2A is a rear perspective of the truss hanger.

Referring to FIG. 1, a first embodiment of a connection system for a fire separation wall is shown generally at 10. Floor trusses generally indicated at 12 each include truss members (broadly, "wooden structural members") including a top chord 14, a bottom chord 16, and web members 18 joining the top and bottom chords. Each floor truss also includes end members 20 at each end joining the top and bottom chords 14, 16 (only one end of each truss is shown). The truss members can be joined by nail plates 22 or by any other suitable fastening structure. The number and orientations of the web members 18 and chords 14, 16 may vary from the illustrated embodiment without departing from the scope of the invention, as a truss hanger 26 according to the present invention is readily applicable to other truss configurations (e.g. a roof truss). Moreover, the hanger 26 may be used to connect structural components other than trusses to a wall or other part of a structure. The hanger can be used to support other wood framing members such as solid sawn or structural composite lumber.

As seen in FIG. 1, a wall 28 includes a top member or plate 30 and support members or studs 32 (only one stud may be seen in FIG. 1). As illustrated, the top plate 30 is formed by two 2×4's in stacked relation. Fire retardant sheathing 34 is mounted on both sides of the wall 28, as illustrated. In one embodiment, the fire retardant sheathing is gypsum board, such as two layers of ⅝" gypsum board mounted on each side of the wall 28 as illustrated, although other configurations of fire retardant sheathing are within the scope of the present invention. Other wall configurations, including different wall constructions and materials, are within the scope of the present invention. For example, the truss hangers 26 can be used with any wall assembly or fire-rated wall assembly, such as a 2-hour fire-resistive wall assembly. The floor trusses 12 are mounted on the wall 28 adjacent the fire retardant sheathing 34 by the truss hangers 26. The truss hangers 26 extend through a narrow slot in the fire retardant sheathing 34 to maintain the integrity and fire retardant characteristics of the fire separation wall.

Referring to FIGS. 2-8, the truss hanger 26 includes a channel-shaped portion 38, an extension portion 40, and a connection portion 42. The channel-shaped portion 38 is configured to receive the floor truss 12. The channel-shaped portion 38 includes a seat or base 44 and a pair of side panels 46 extending upward from the base. When installed, the base 44 is generally horizontal, and the side panels 46 extend generally vertical from the base. A back panel 48 extends from each of the side panels 46. Each back panel 48 is generally perpendicular to both the side panels 46 and the base 44. When installed, each back panel 48 extends generally parallel to an interior face 50 of the fire retardant sheathing 34. The base 44, side panels 46, and back panels 48 form a channel 52 configured to receive the floor truss 12.

As seen in FIGS. 1 and 12-14A, the floor truss 12 is received in the channel 52 to attach the floor truss to the wall 28. The bottom chord 16 of the floor truss 12 engages and rests upon (i.e., is supported by) the base 44. The end member 20 of the floor truss 12 is positioned against the back panels 48 between the side panels 46. The truss hanger 26 includes fastening structure for attaching the floor truss 12 to the truss hanger. Fastening structure can be of any type known in the art for attaching a connector to a wooden structural member, such as nailing teeth (not shown) struck from the material of the hanger. In the illustrated embodiment, the fastening structure comprises a hole to allow for insertion of a fastening member. More specifically, in one embodiment the fastening structure comprises nail holes 54 in the side panels 46 of the truss hanger 26, and the fastening member comprises a nail 56 (see FIG. 12). In the illustrated embodiment, nail holes 54 are positioned on each of the side panels 46 so that nails 56 can be inserted into both the bottom chord 16 and the end member 20 of the floor truss 12 to attach the hanger 26 to the floor truss 12.

Figure 3:
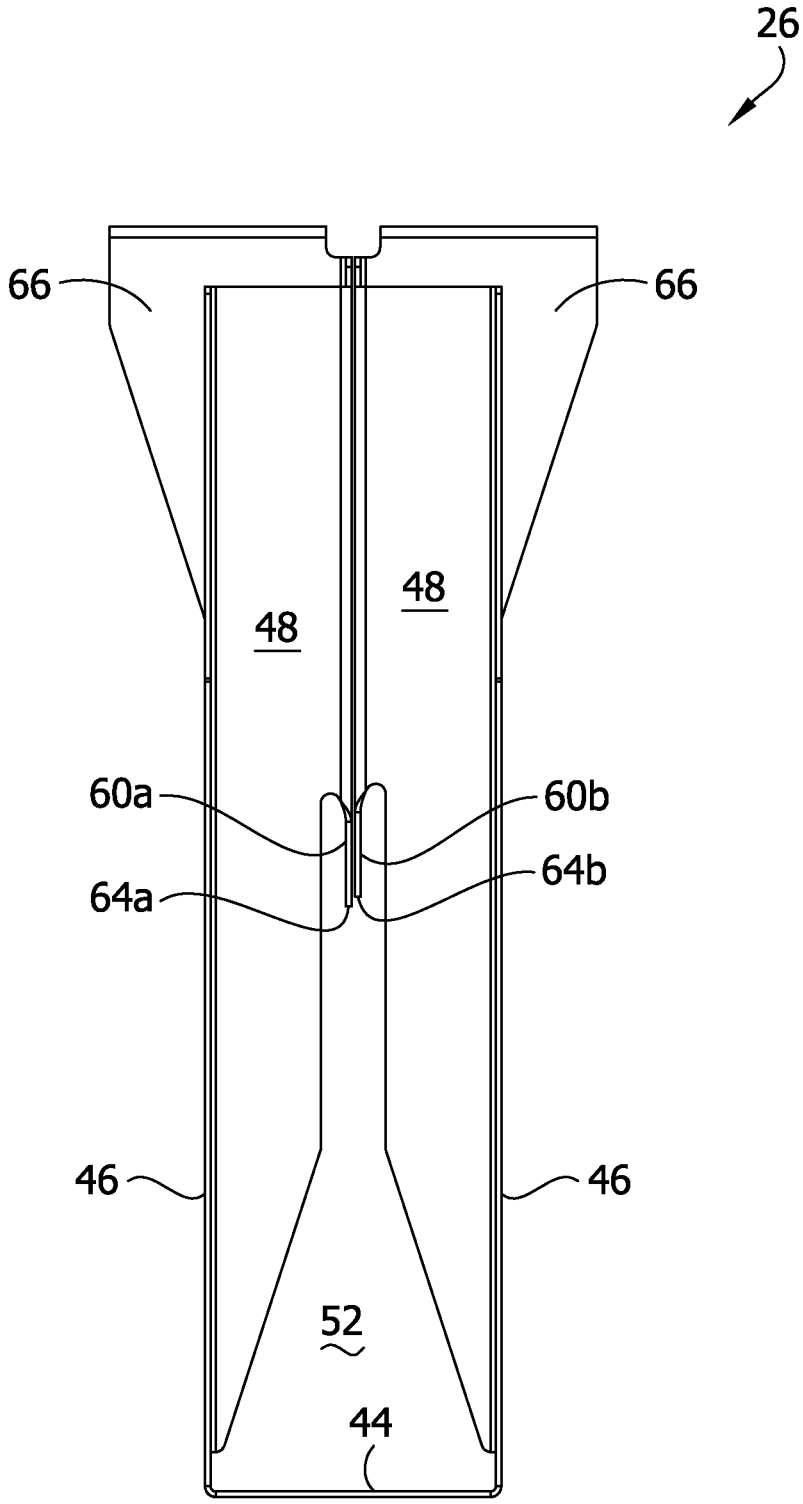
FIG. 3 is a front elevation thereof.
Figure 4:
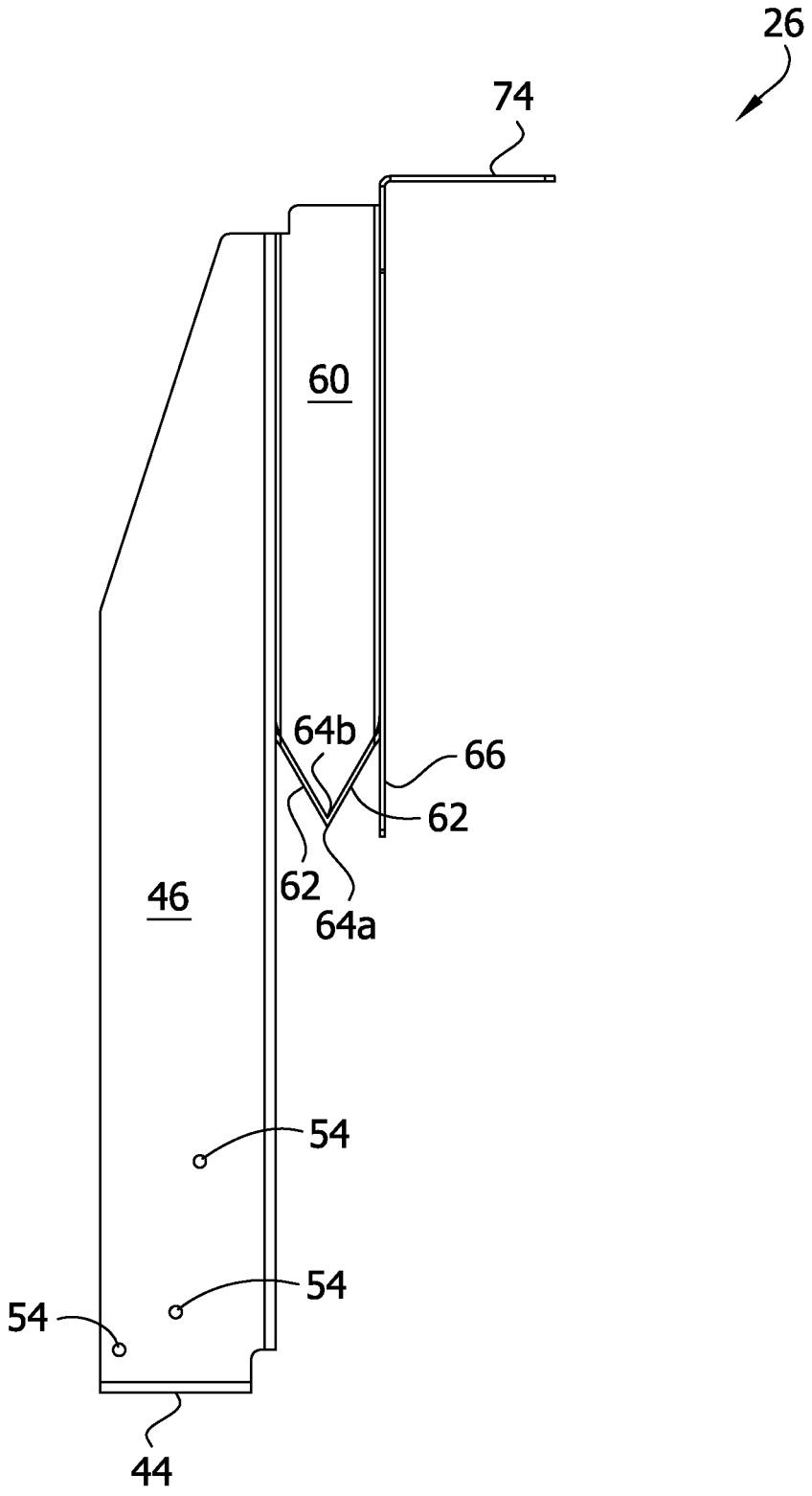
FIG. 4 is a right side elevation thereof.
Figure 5:
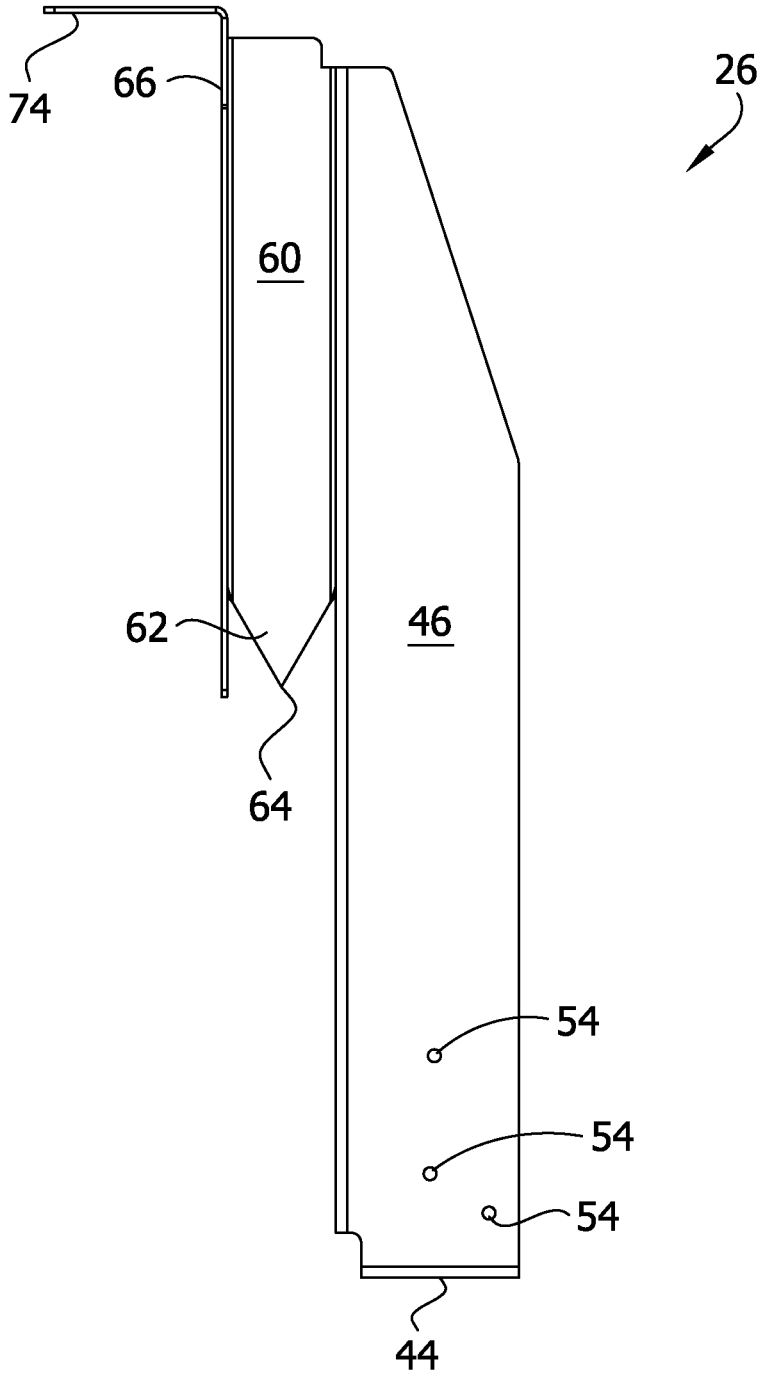
FIG. 5 is a left side elevation thereof.
Figure 6:
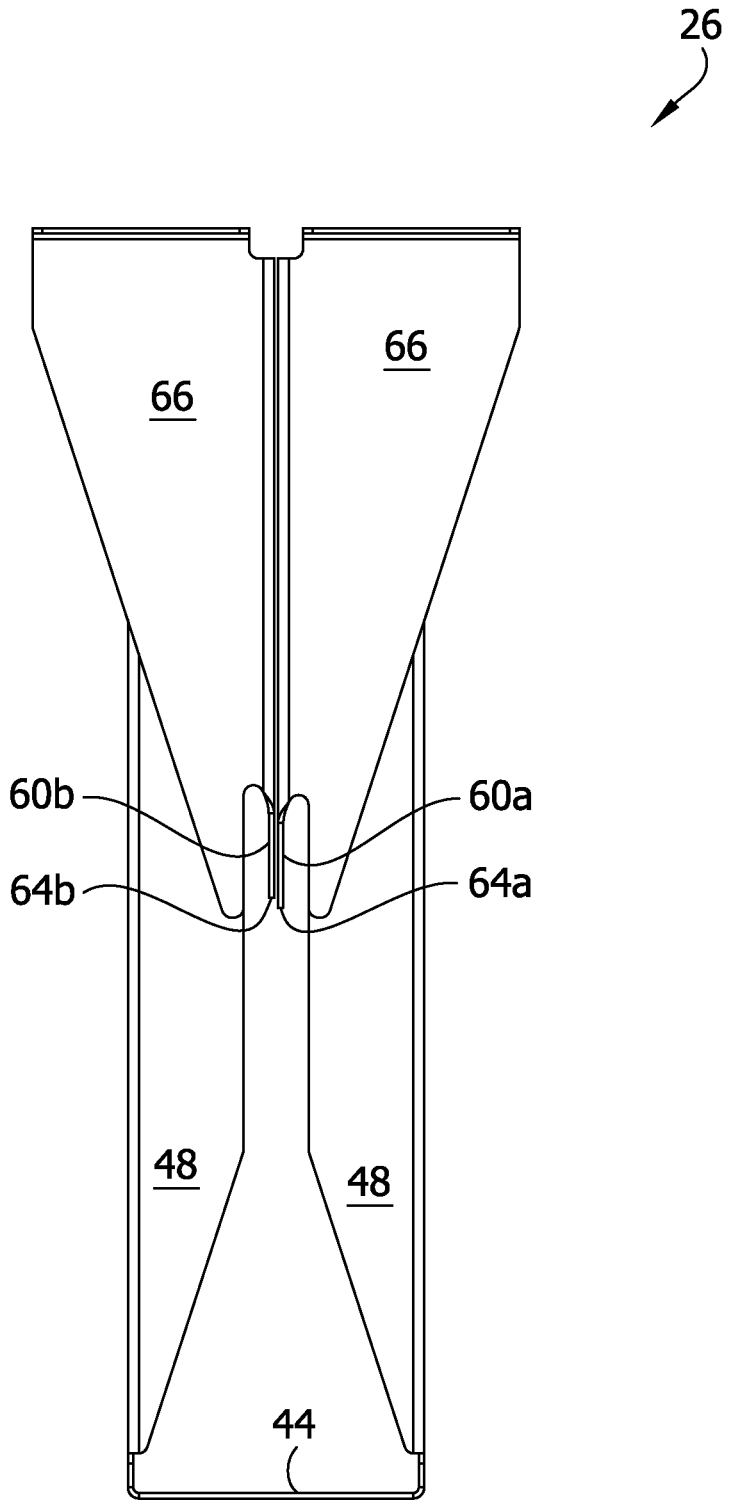
FIG. 6 is a rear elevation thereof.

Referring again to FIGS. 2-8, the extension portion 40 includes two extension flanges 60 configured to extend through the fire retardant sheathing 34. Each flange 60 extends from one of the back panels 48. The flanges 60 are positioned in opposed, face-to-face relation, and preferably engage each other along a juncture. Each flange 60 extends generally perpendicular from the corresponding back panel 48 and generally parallel to the side panels 46. At a bottom edge, each flange 60 includes a driving point 62. Each of the driving points 62 is generally triangular and includes a pointed tip 64. As seen in FIGS. 3 and 6, the tips 64 of the driving points 62 are vertically offset from each other. As illustrated, the tip 64*a* of one flange 60*a* extends vertically below the tip 64*b* of the other flange 60*b*. In one embodiment, the tips 64 are vertically offset from each other about ⅛", although other configurations are within the scope of the present invention, such as tips that are aligned or tips that are offset a smaller or larger amount.

Figure 7:
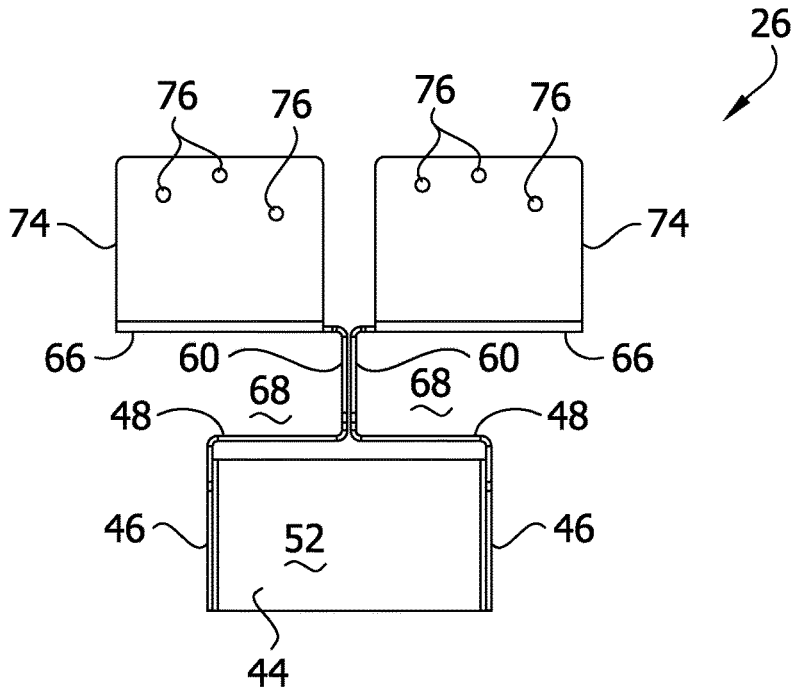
FIG. 7 is a top plan thereof.
Figure 8:
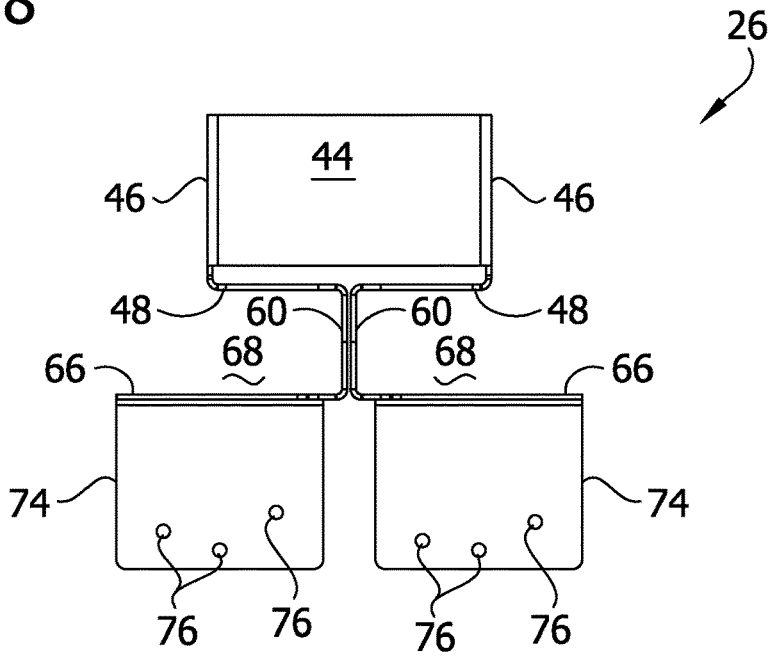
FIG. 8 is a bottom plan thereof.
Figure 9:
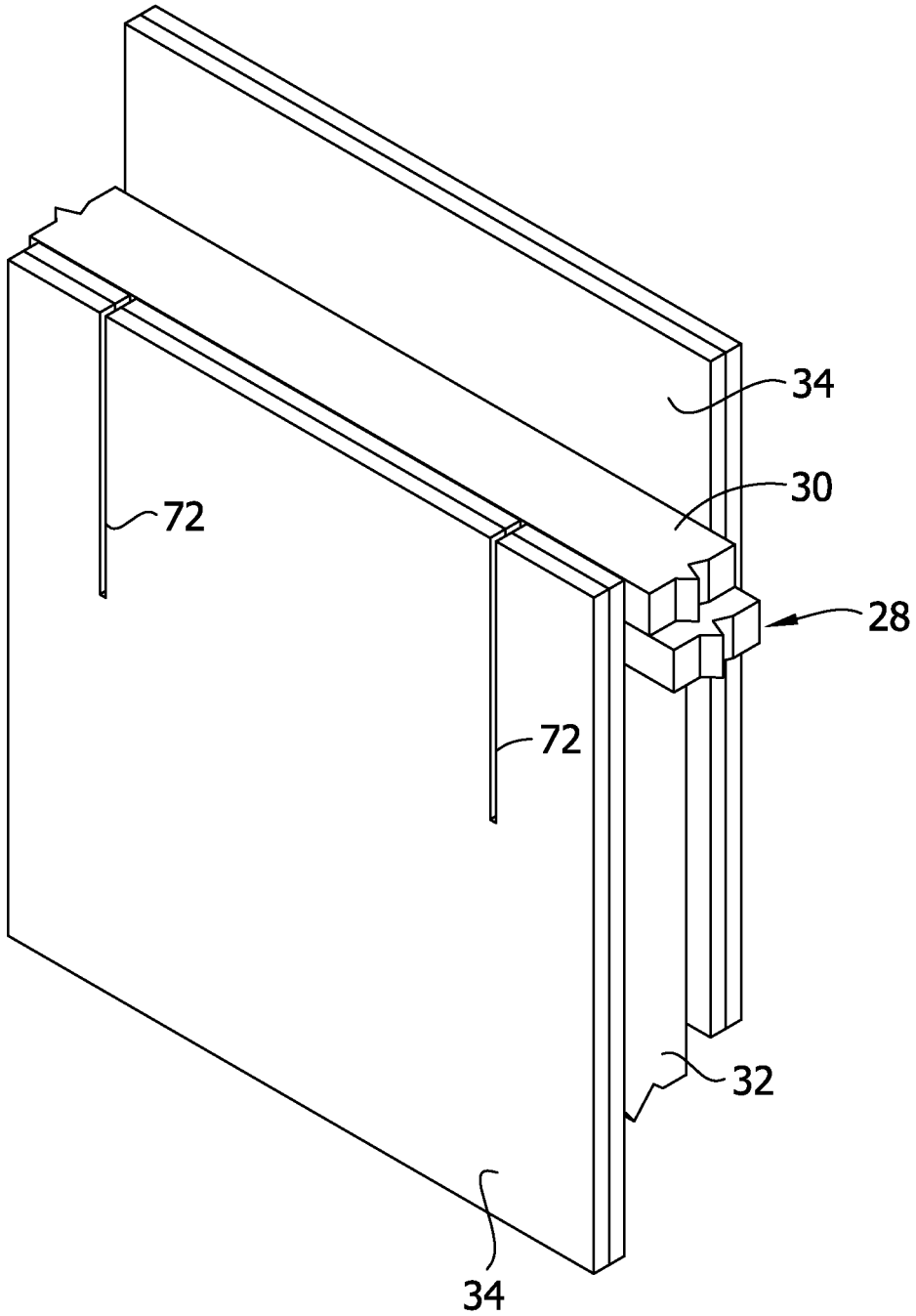
FIG. 9 is a perspective of a wall having fire retardant sheathing with a slot cut in the sheathing to receive the truss hanger.
Figure 13:
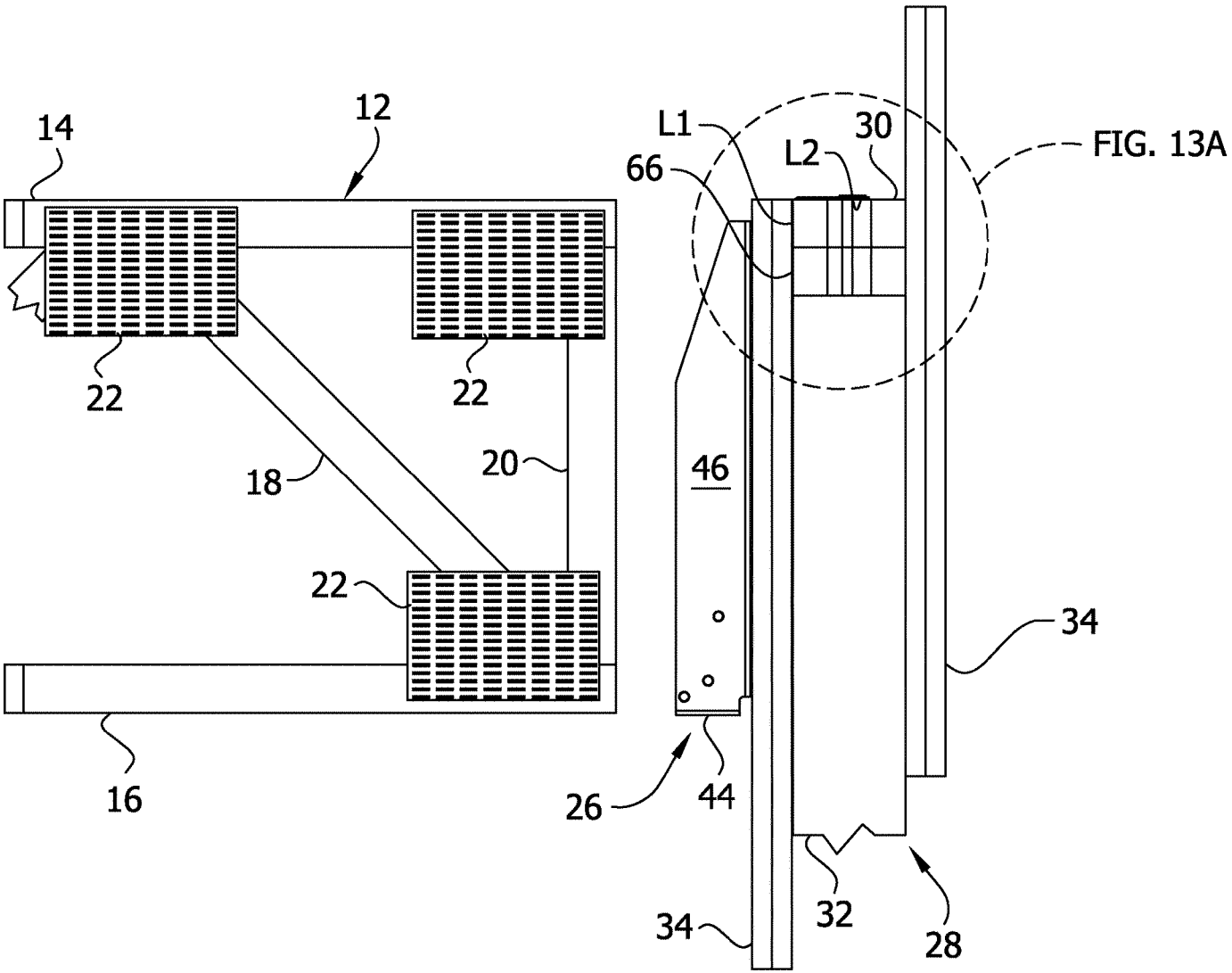
FIG. 13 is a side elevation of FIG. 12.
Figure 13A:
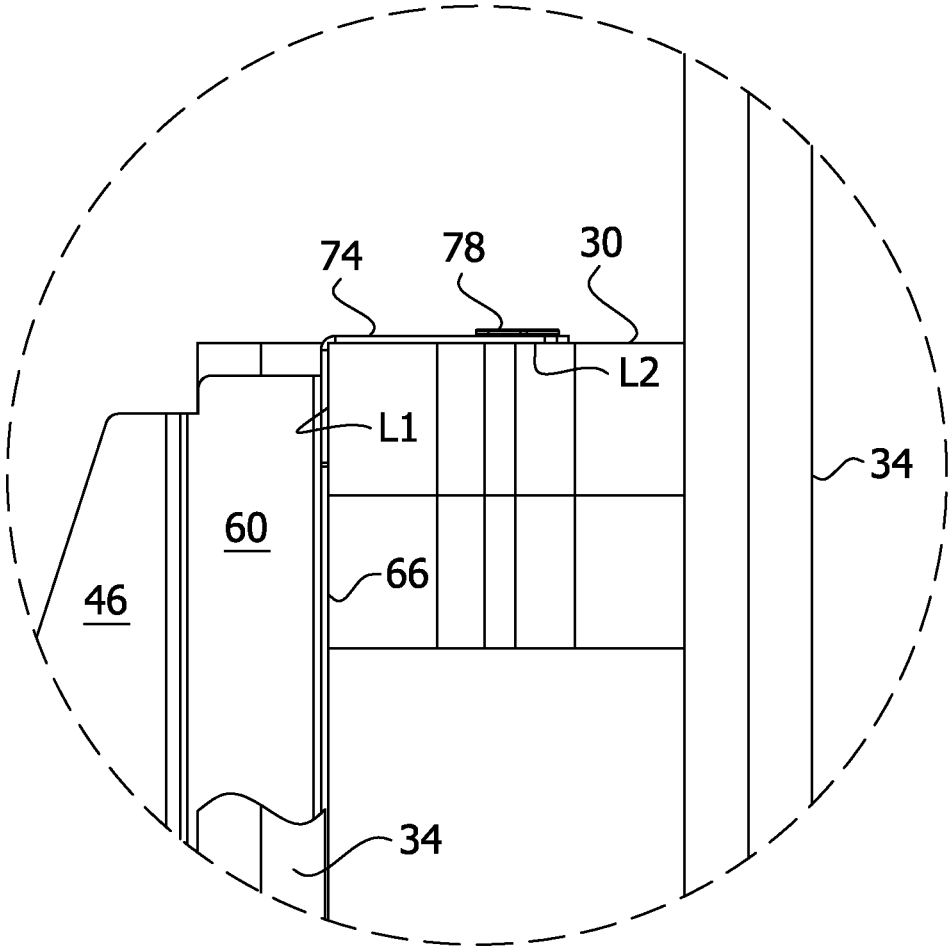
FIG. 13A is an enlarged fragmentary perspective of FIG. 13 with a portion of the fire retardant sheathing broken away.
Figure 14:
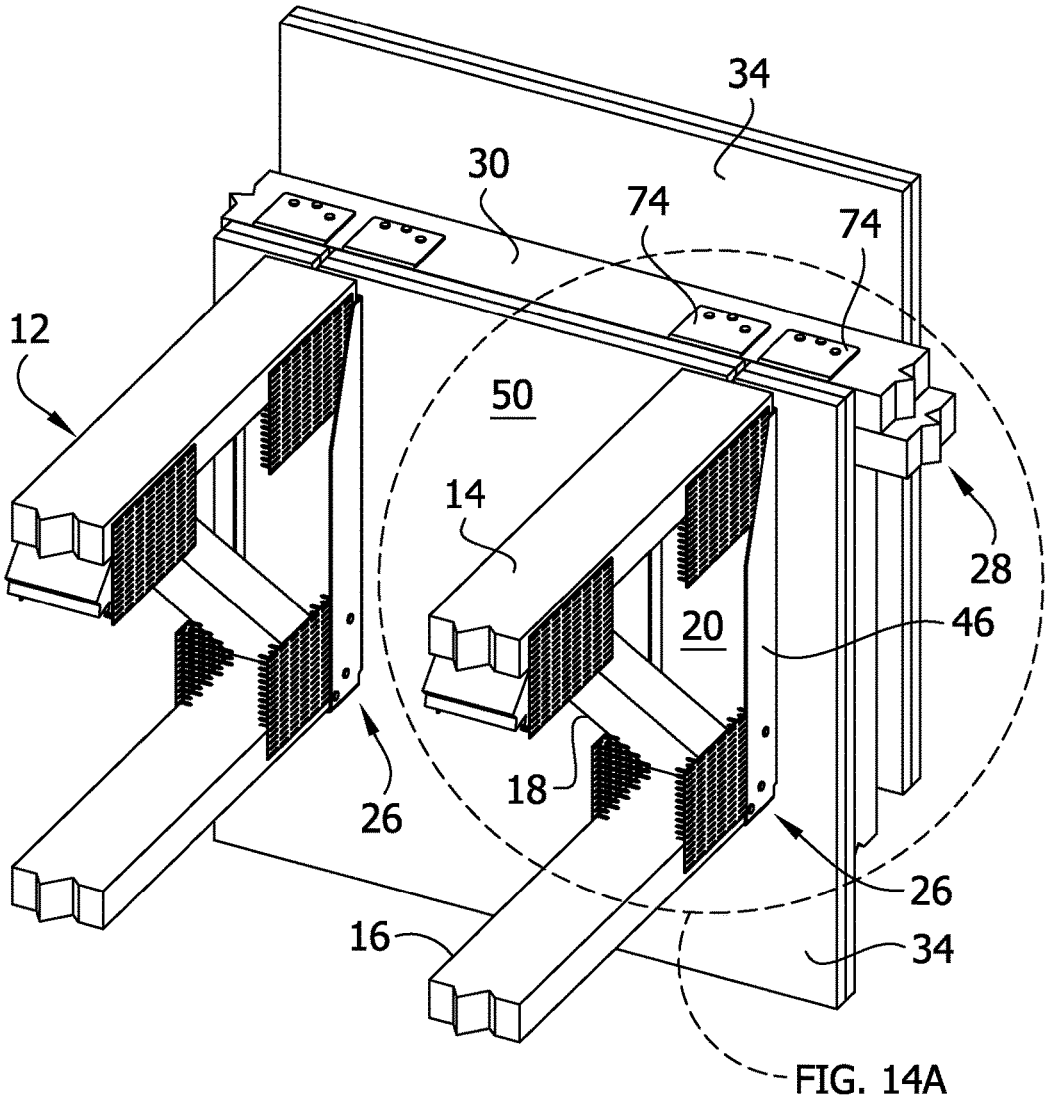
FIG. 14 is the perspective of FIG. 10, but showing floor trusses mounted in the truss hangers.
Figure 14A:
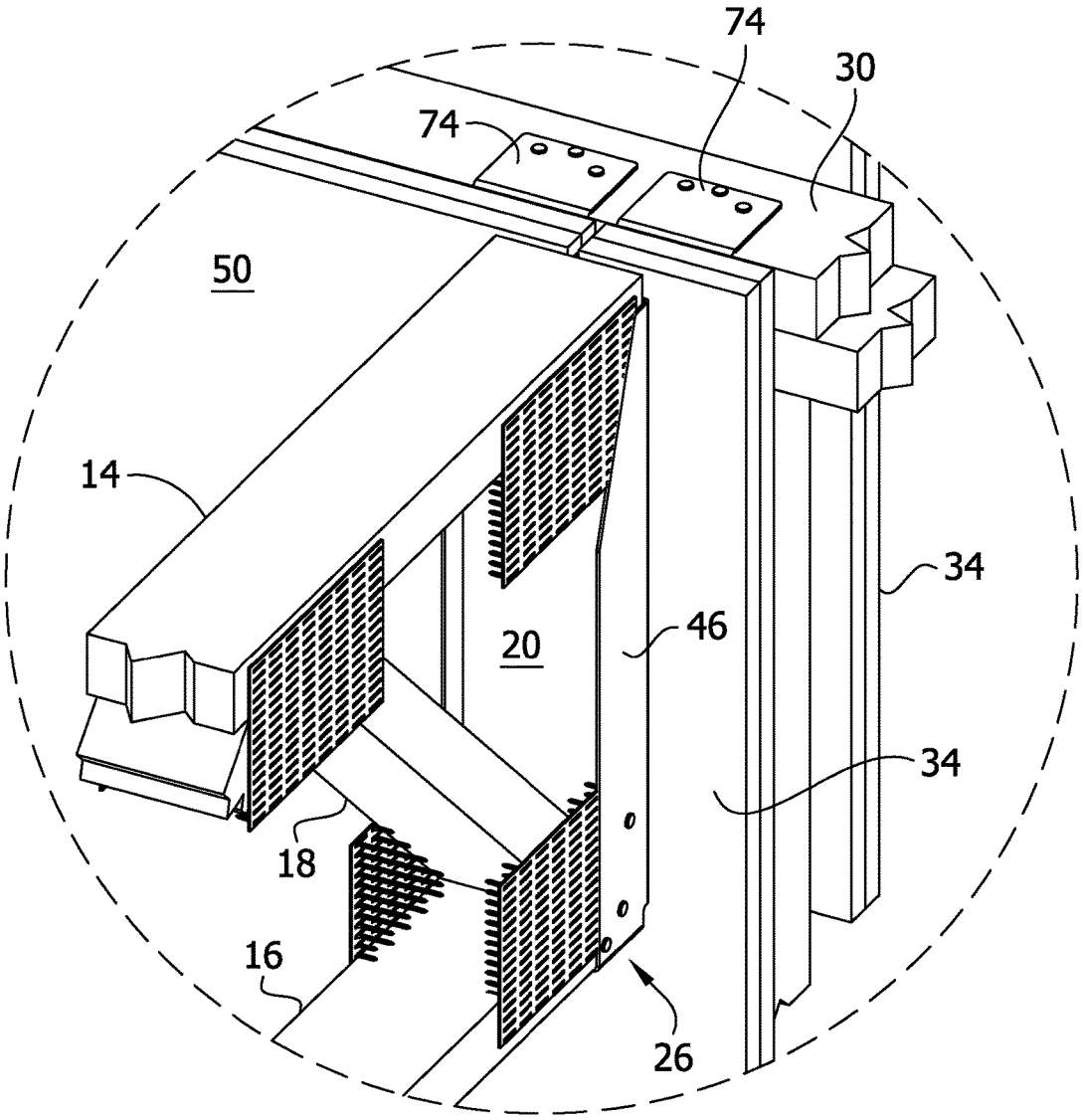
FIG. 14A is an enlarged fragmentary perspective of FIG. 14.

A back flange 66 extends from each of the extension flanges 60. Each back flange 66 extends generally perpendicular from the extension flange 60 and is oriented generally parallel to the back panels 48. Referring to FIG. 13A, the back flanges 66 engage the wall 28 at a first location $L_1$, which in the illustrated embodiment is a vertical face of the top plate 30 of the wall. The back panels 48, extension flanges 60, and back flanges 66 form a pair of sheathing channels 68. Each sheathing channel 68 is configured to receive a portion of the fire retardant sheathing 34 to secure the sheathing between the hanger 26 and the wall 28. As seen in FIG. 7, the sheathing channels 68 extend generally perpendicular to the truss-receiving channel 52.

Figure 10:
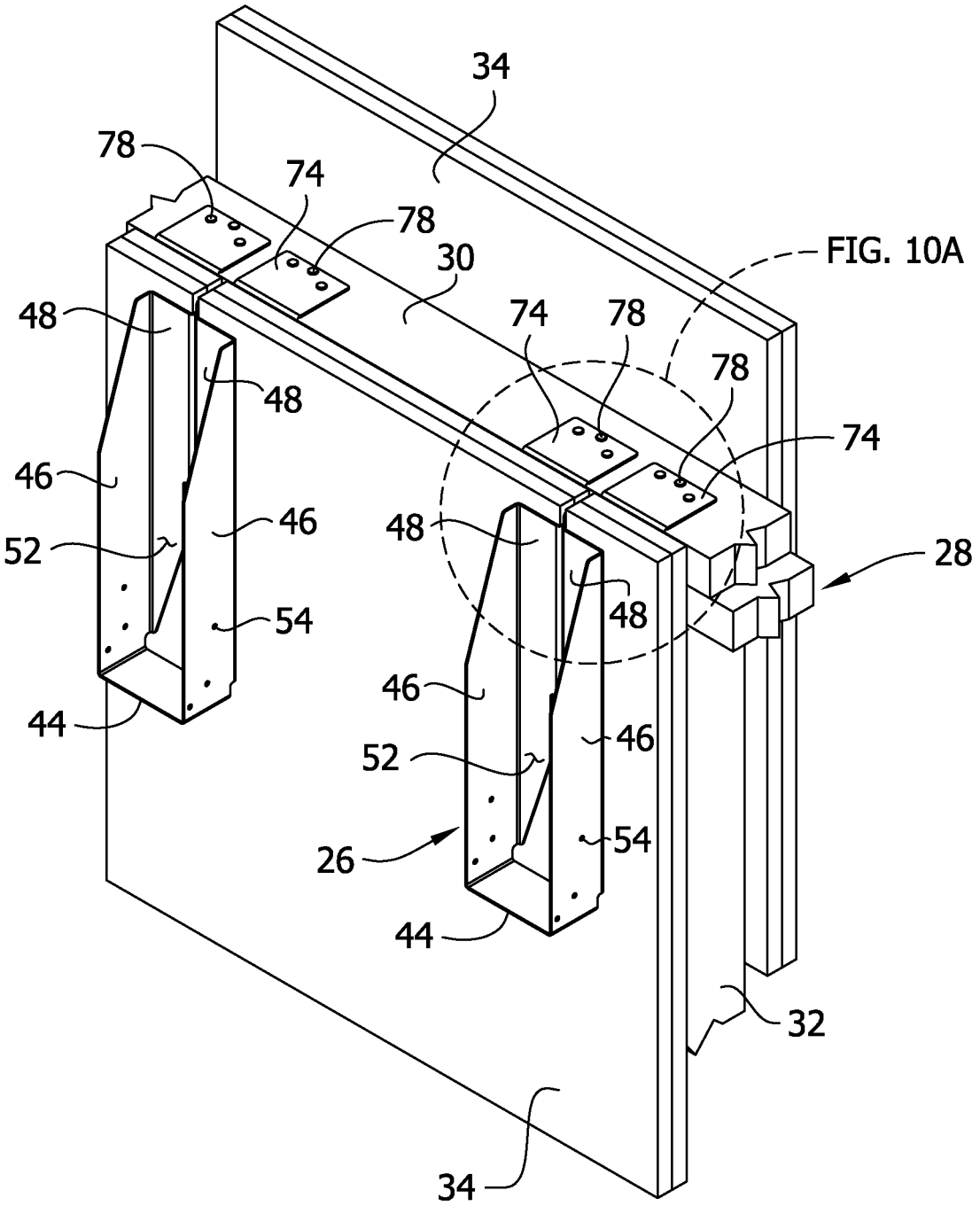
FIG. 10 is the perspective of FIG. 9, but showing two of the truss hangers mounted thereon.
Figure 10A:
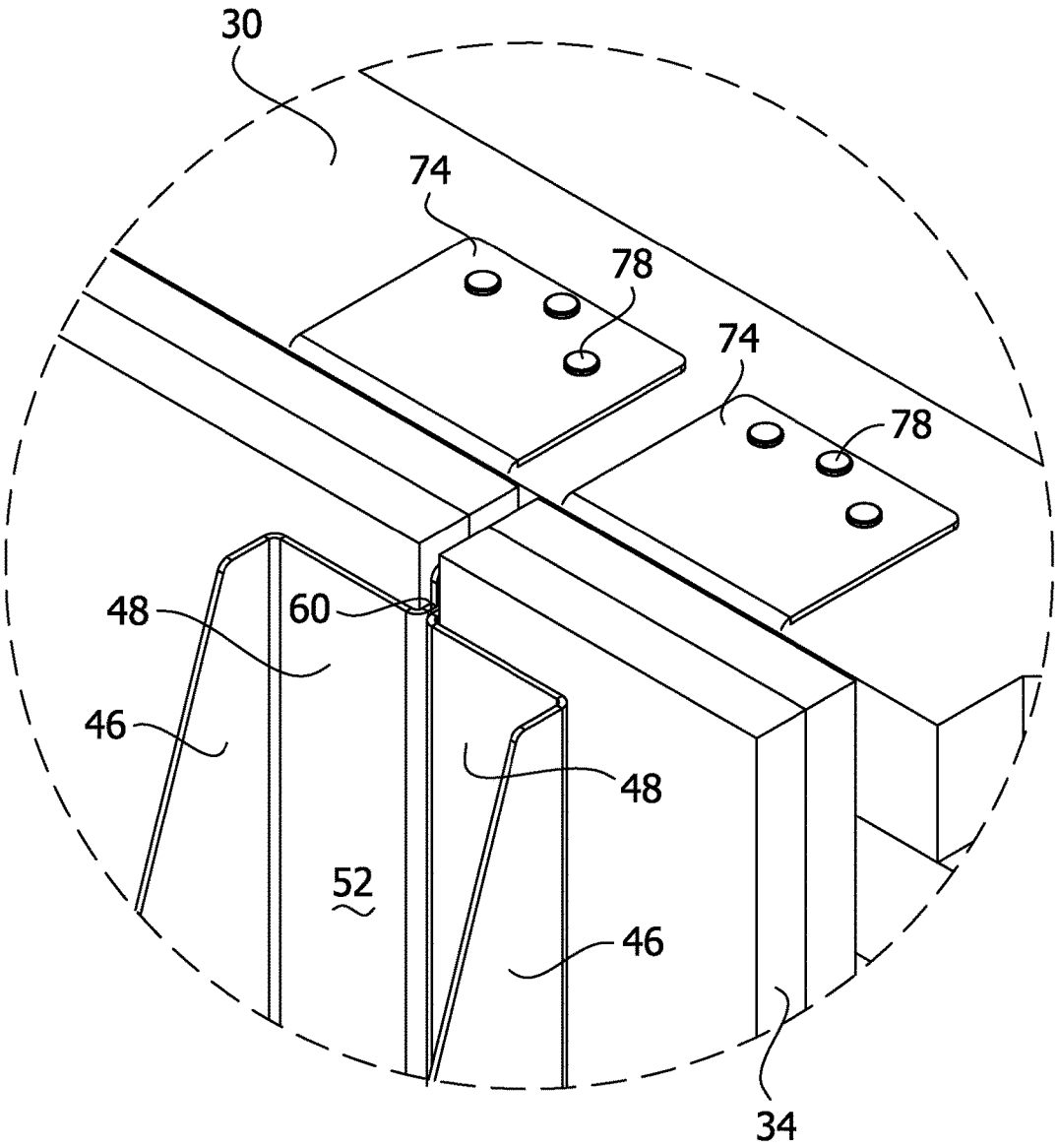
FIG. 10A is an enlarged fragmentary perspective of FIG. 10.
Figure 11:
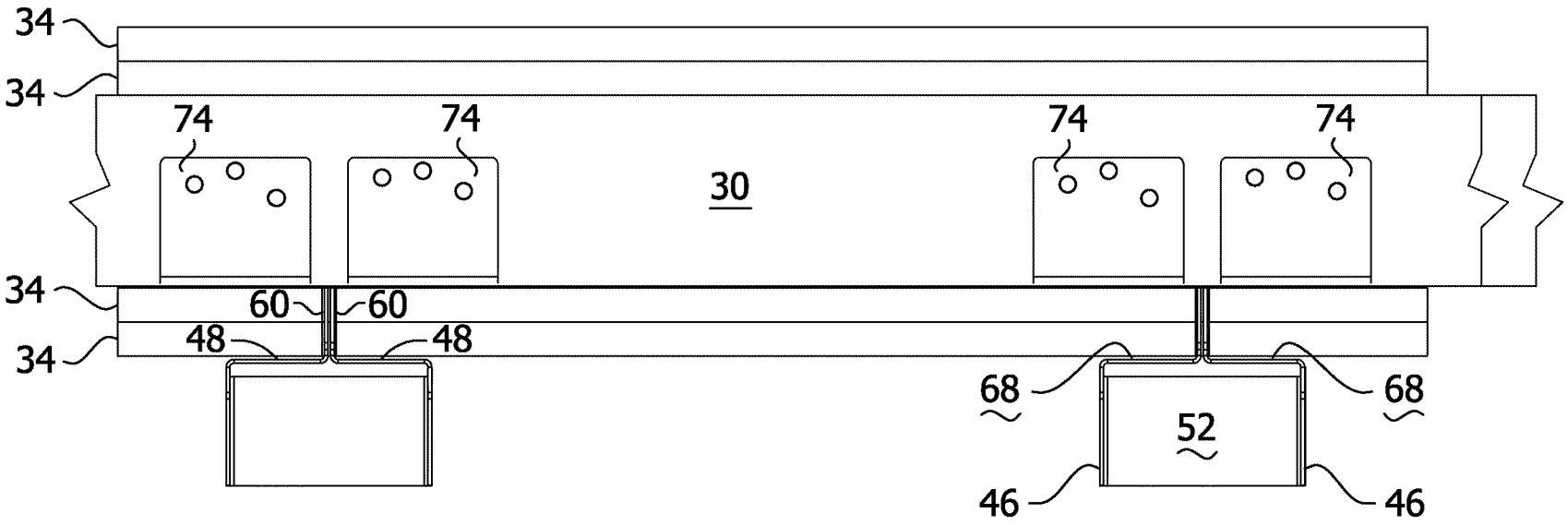
FIG. 11 is a top plan of FIG. 10, illustrating the truss hanger extending through the fire retardant sheathing.
Figure 12:
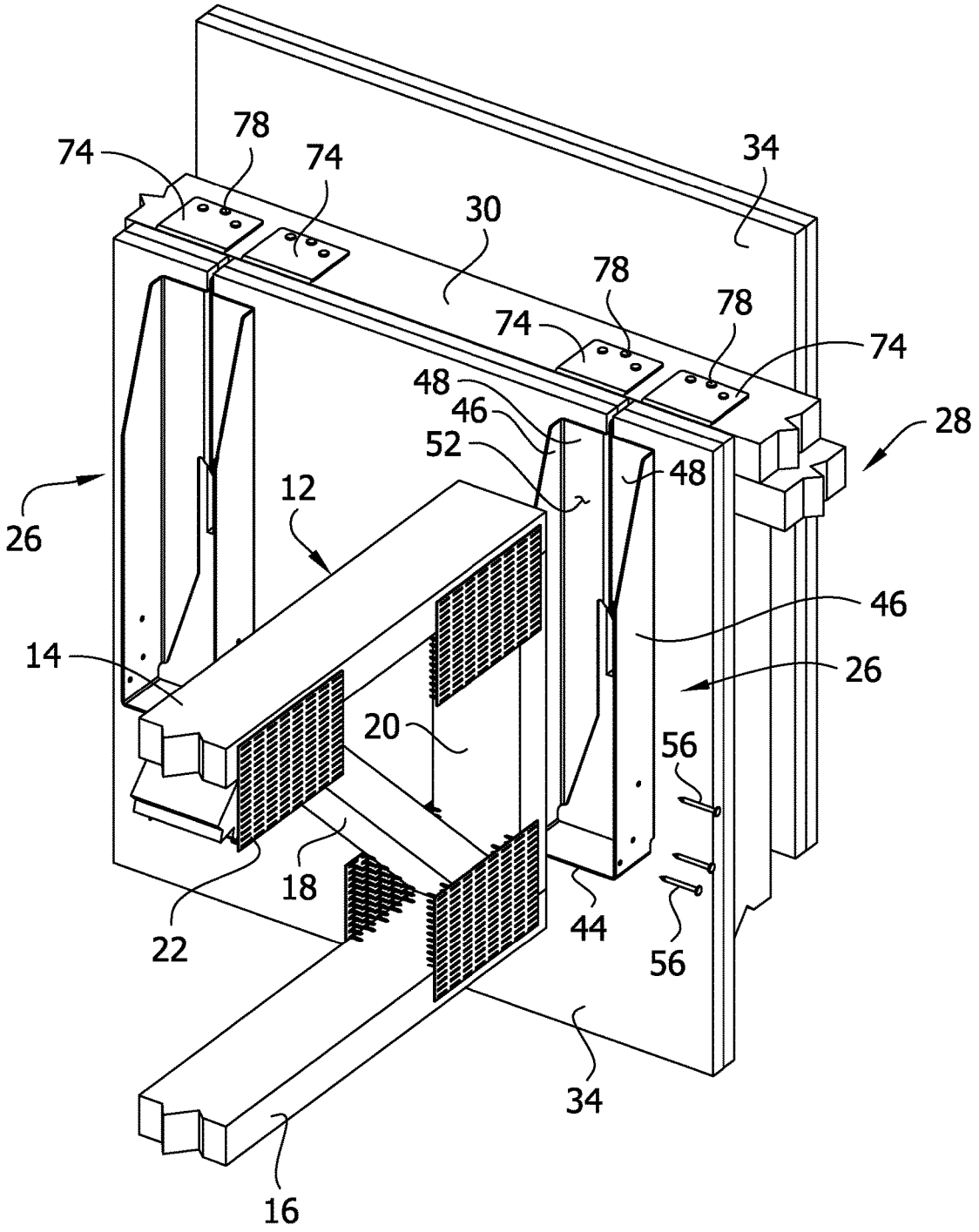
FIG. 12 is a perspective similar to FIG. 10, but showing a floor truss positioned for mounting in the truss hanger.

As seen in FIGS. 10A and 11, the extension flanges 60 extend through a slot 72 in the fire retardant sheathing 34. Preferably, the slot has an area less than or equal to 6 square inches, and the gap between the extension flanges 60 and the edge of the slot 72 is less than or equal to ⅛". The driving points 62 extend down into the sheathing 34 to further secure the sheathing between the hanger 26 and the wall 28. A portion of the fire retardant sheathing 34 extends into each sheathing channel 68 and is secured between the back panels 48 and the back flanges 66.

In one embodiment, the slot 72 in the fire retardant sheathing 34 can be made using a slot template 82 (FIGS. 16-24). The slot template 82 includes a vertical panel 84 having a rear face 86 configured to engage the interior face 50 of the fire retardant sheathing 34 and a horizontal panel 88 having a bottom face 90 configured to engage a top face of the sheathing. The horizontal panel 88 extends generally perpendicular from the vertical panel 84. The slot template 82 is configured to be quickly fixed in position on the sheathing 34 for use in cutting the slot 72 to receive the truss hanger 26. Portions of the slot template 82 are configured to be pressed into the sheathing 34 to locate the template on the sheathing and retain the template in position for cutting the slot 72. In the illustrated embodiment, the horizontal panel includes prongs 92 that are bent downward for insertion into the top face of the sheathing 34. Bottom corners 94 of the vertical panel 84 are bent rearward for insertion into the interior face 50 of the sheathing 34. The prongs 92 and the corners 94 are inserted into the sheathing 34 to retain the template 82 in position for cutting the slot 72. In addition, the vertical panel 84 optionally includes dimples 96 extending toward the rear face 86 of the vertical panel 84. The dimples 96 ensure the vertical panel 84 remains slightly spaced from the interior face 50 of the sheathing 34 so the template 82 can be easily removed from the sheathing after the slot 72 is cut.

The template 82 includes a guide slot 98 to guide a cutting tool in cutting the slot 72 in the sheathing 34. The guide slot 98 extends from a top edge of the vertical panel 84 to a location spaced from a bottom edge of the vertical panel. As illustrated, the guide slot 98 includes a wide, rectangular portion 98*a* in the horizontal panel 88 to ease insertion of a cutting tool into the guide slot. A converging portion 98*b* of the slot 98 in the vertical panel 84 transitions from the wide portion 98*a* to a narrow lower portion 98*c* of the slot. This facilitates entry of the cutting tool into the narrow portion 98*c*. The narrow portion 98*c* of the guide slot 98 is dimensioned to facilitate cutting the slot 72 in the sheathing 34 to a size configured to receive the extension flanges 60 of the truss hanger 26.

Figure 24:
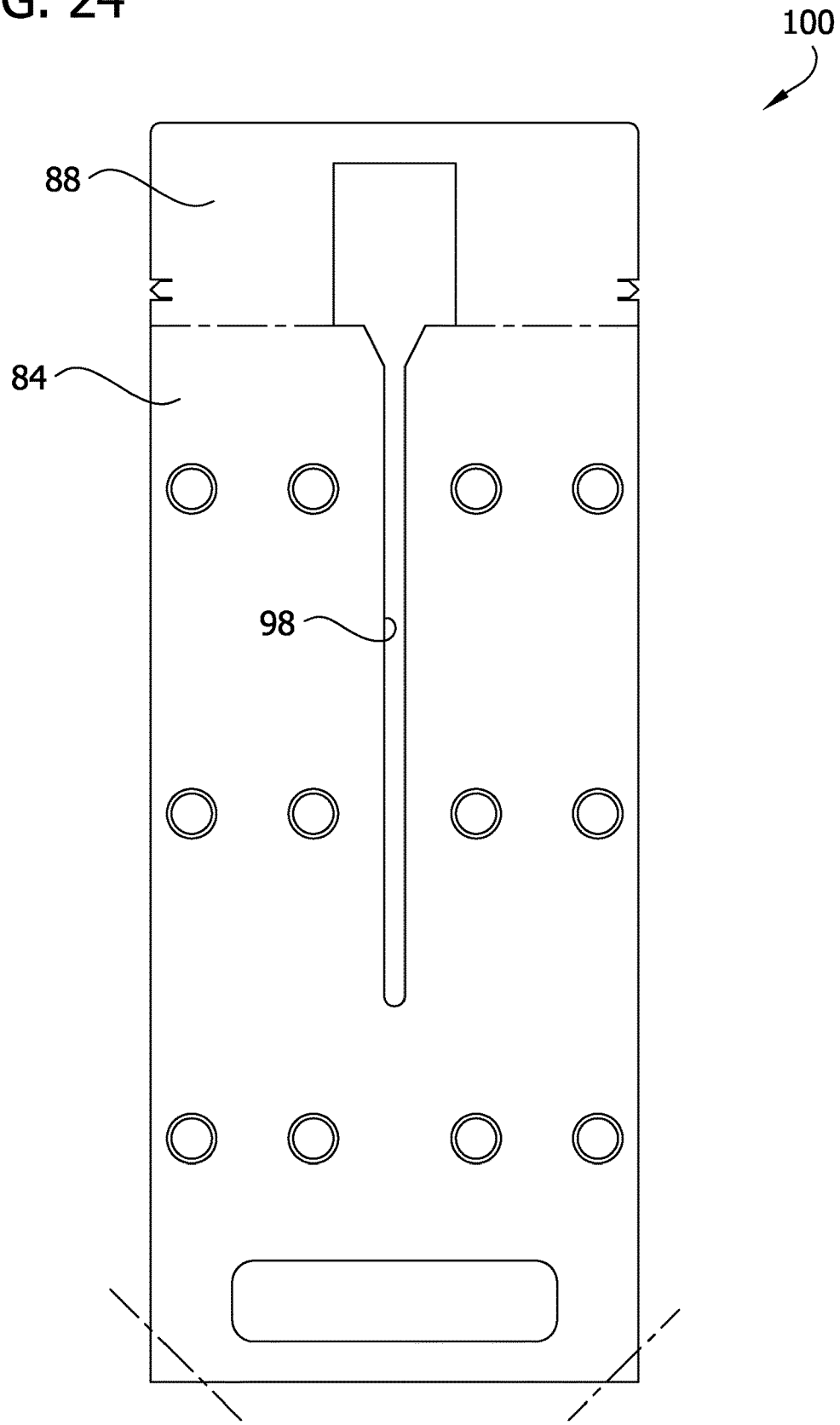
FIG. 24 is a front view of a stamped metal blank for forming the slot template.

As seen in FIG. 24, the template 82 described above can be formed as one piece from a metal blank 100 that is stamped from a sheet metal roll and bent into shape. In one embodiment, the template 82 is stamped from 16 gauge steel, although other thicknesses (e.g., 12-18 gauge) and other suitable materials are within the scope of the present invention.

In use, the template 82 is placed on the sheathing 34 in a selected location for a slot 72. The template can be used to cut the slot 72 in the sheathing 34 either before or after the sheathing is mounted on the wall 28. The prongs 92 and corners 94 are inserted into the sheathing 34 by tapping with a hand or striking with a hammer or other blunt instrument. Once the template 82 is secured in position on the sheathing 34, a cutting tool (e.g., a drywall cutout tool) is inserted into the guide slot 98 to cut a slot 72 in the sheathing at the location of the guide slot. In one embodiment, a drywall cutout tool with a ⅛" or ¼" spiral bit is used to cut the slot 72, although other cutting tools are within the scope of the present invention. After the slot 72 is cut in the sheathing 34, the template 82 is removed from the sheathing. The sheathing 34 is then configured to receive the truss hanger 26.

Referring again to FIGS. 2-8, the connection portion of the hanger includes a pair of connector tabs 74 extending from the back flanges 66. Each connector tab 74 extends generally perpendicular from one of the back flanges 66. The connector tabs 74 are generally horizontal when the hanger 26 is installed. The connector tabs 74 are configured to engage an upper surface of the top plate 30 of the wall 28 at a second location $L_2$ spaced from the first location $L_1$. The connector tabs 74 can be used to attach the truss hanger 26 to the wall, thereby hanging the floor trusses 12 from the wall. As seen in FIG. 1, the connector tabs 74 extend over a portion of the top plate 30 of the wall 28. Each connector tab 74 includes fastening structure, such as nail holes 76, for insertion of a fastening member, such as nails 78 (see FIGS. 10 and 10A), to attach the hanger 26 to the wall 28. In the illustrated embodiment, each connector tab 74 includes three nail holes 76. Other configurations are within the scope of the present invention, such as a different number of nail holes, or alternate fastening structure such as nailing teeth or other appropriate structure for fastening the hanger to the wall.

The base 44 and back flanges 66 of the truss hanger 26 cooperate to stabilize the truss hanger 26 and protect the fire retardant sheathing 34 under the loads transferred from the truss 12 to the wall 28 by way of the hanger. The channel 52 that receives an end portion of the truss 12 is spaced to the interior of the wall 28 and more particularly to the interior of the second location $L_2$ where the connector tabs 74 are attached to an upper surface of the top plate 30. The vertically downward load of the truss 12 applied to the base 44 of the truss hanger 26 urges the truss hanger 26 to pivot so that the base would move toward the wall 28, which could damage the fire retardant sheathing 34 and pry out the nails 78 connecting the connector tabs 74 to the upper surface of the top plate 30. However, this motion is resisted by the engagement of the back flanges 66 with the interior vertical face of the top plate 30 at the first location $L_1$. Thus, there is a force couple between the base 44 of the hanger 26 carrying the vertical load of the truss 12 and the back panels 48 of the hanger (via engagement of the back flanges 66 with the top plate 30) engaging the end face of the truss. Accordingly, the truss hanger 26 and truss 12 are stable with minimal disruption of the fire retardant sheathing 34, even though the truss is held at a distance from the wall 28 by the truss hanger.

Figure 15:
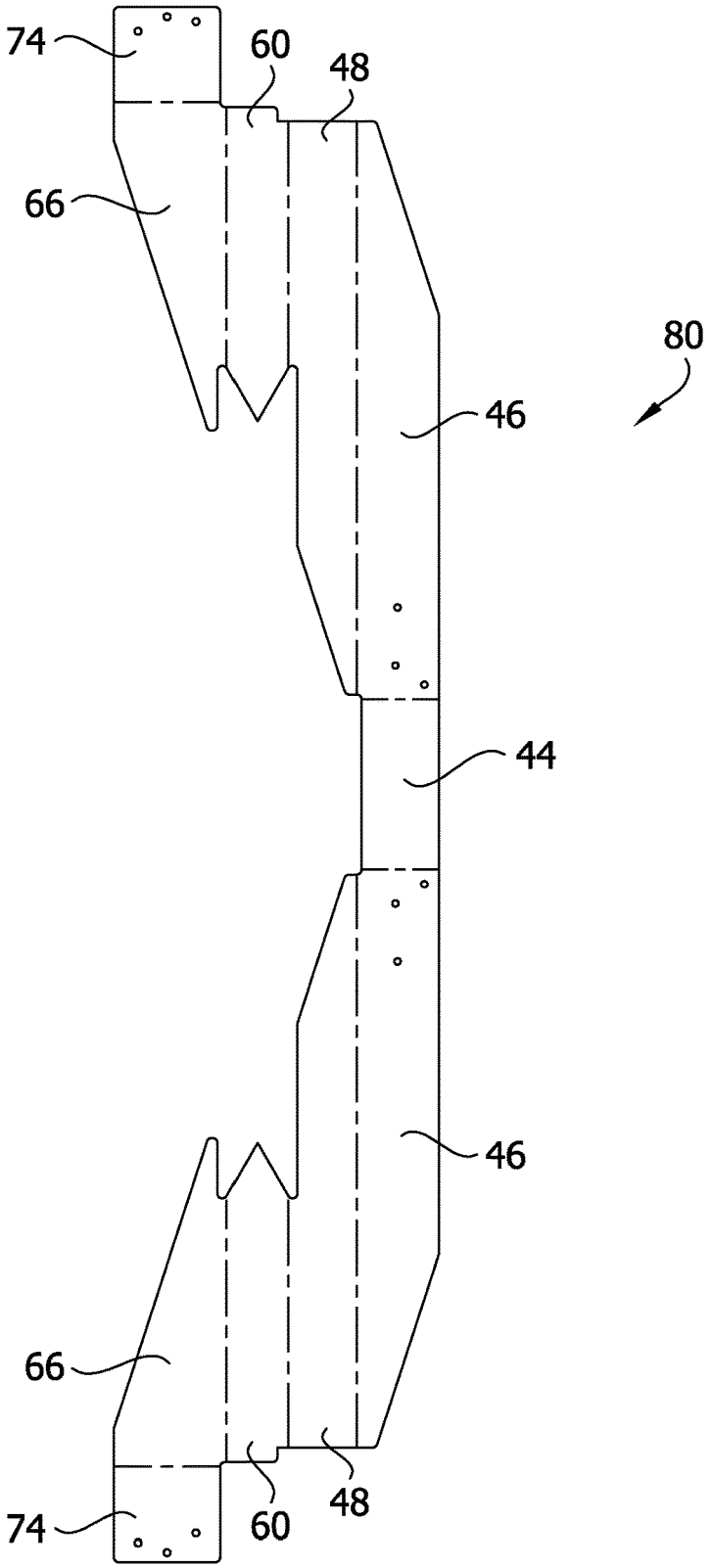
FIG. 15 is a top view of a stamped metal blank for forming a truss hanger according to the present invention.
Figure 16:
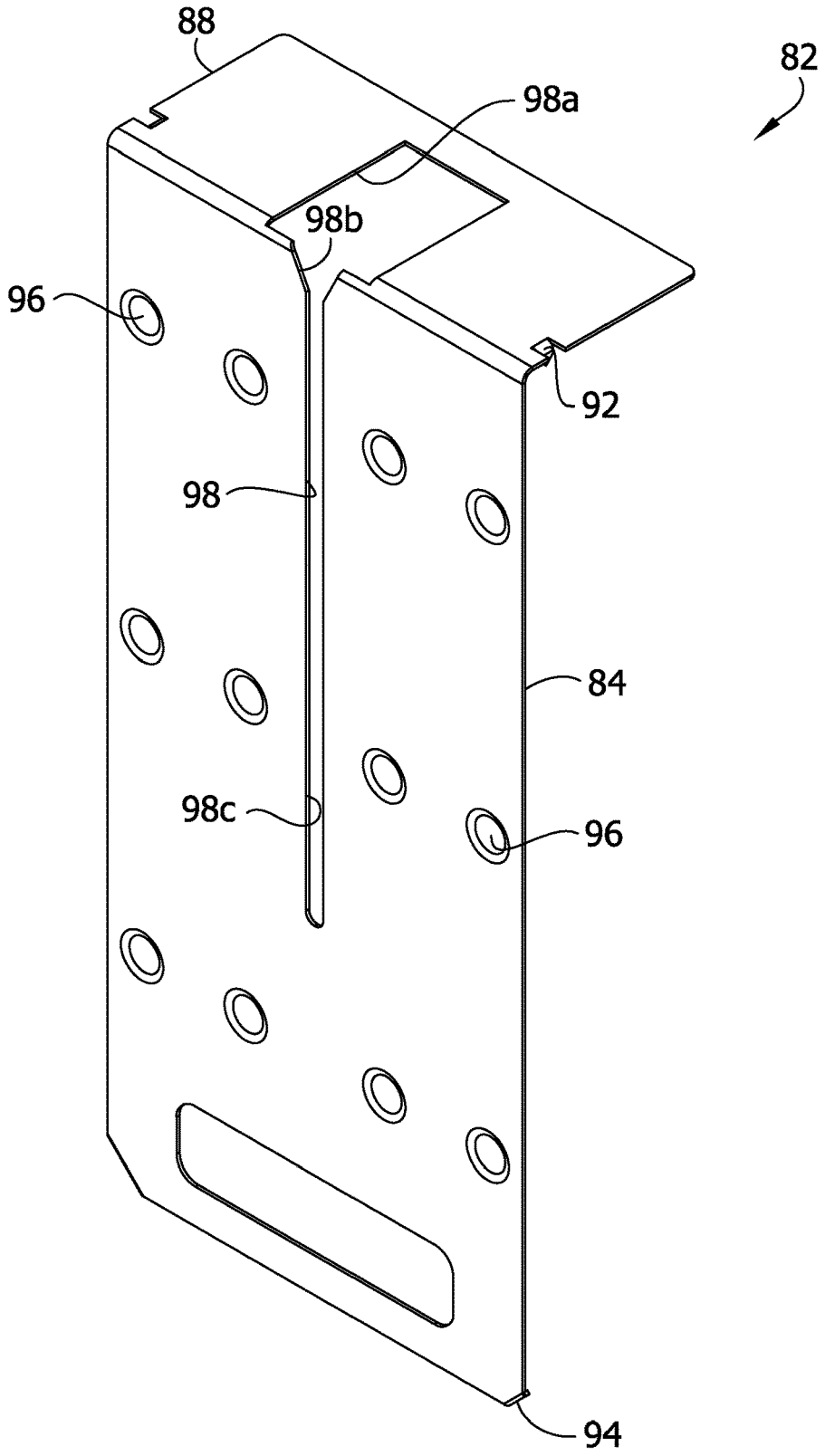
FIG. 16 is a perspective of a slot template for use in cutting the slot in the sheathing to receive the truss hanger.
Figure 17:
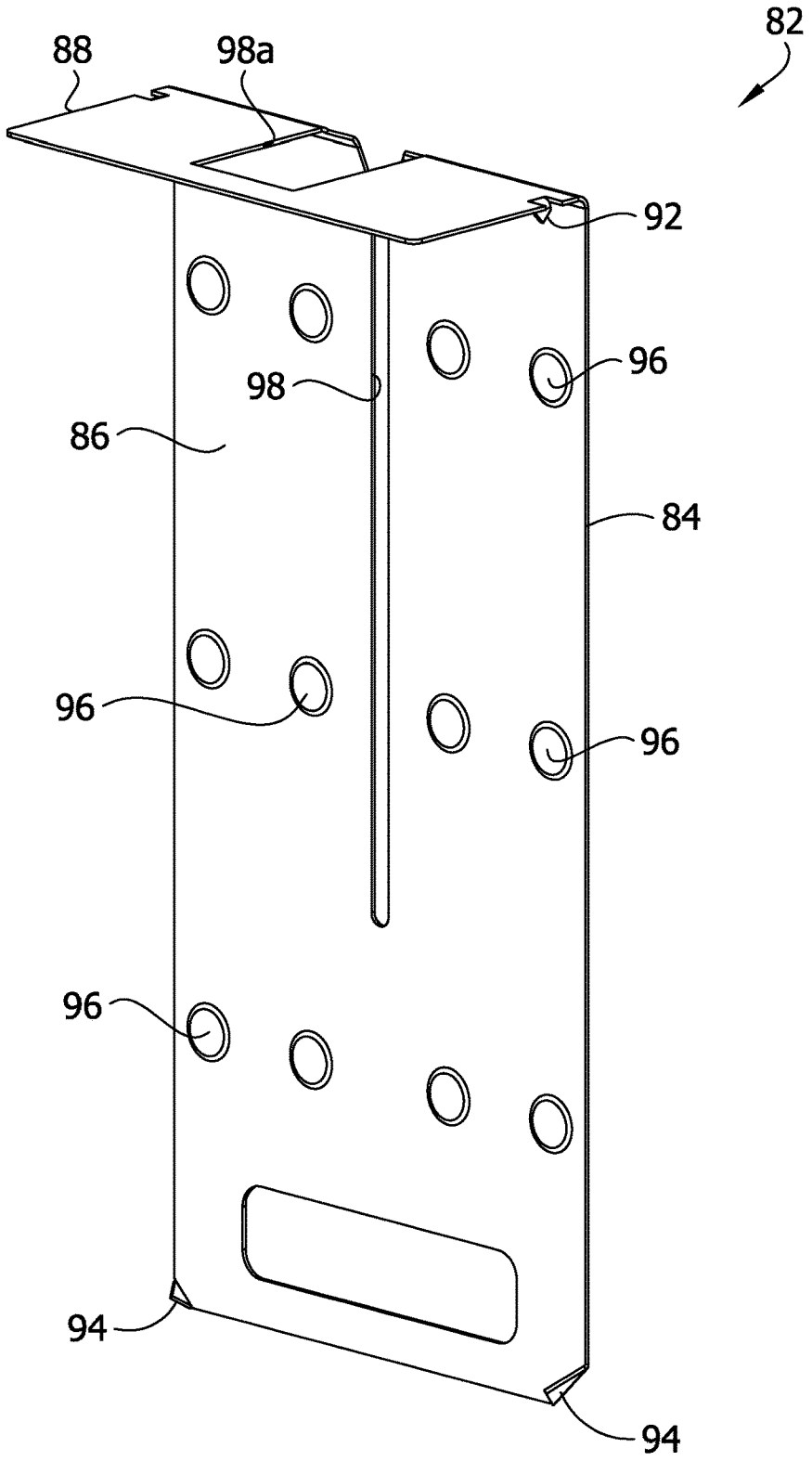
FIG. 17 is a rear perspective of the slot template.
Figure 18:
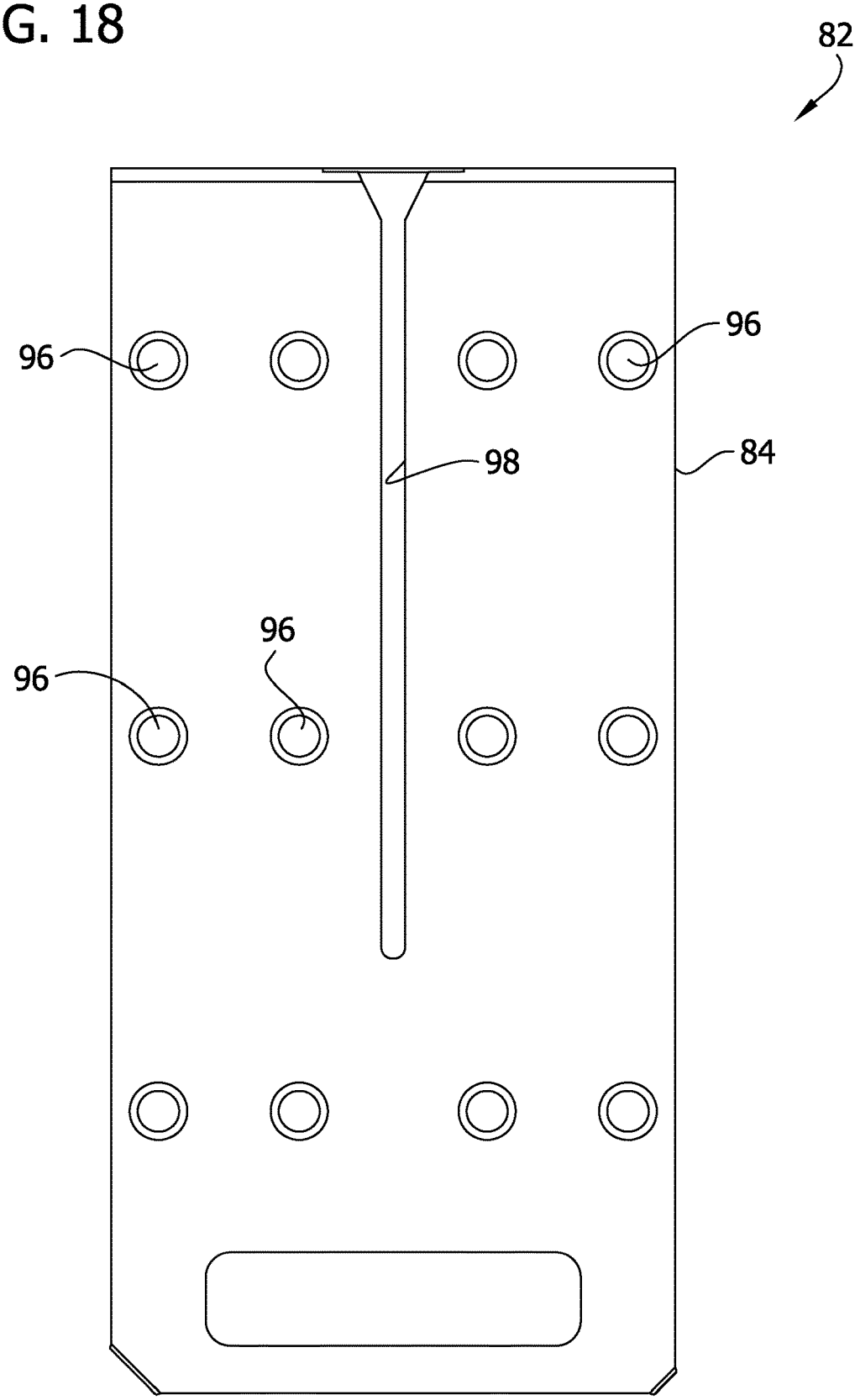
FIG. 18 is a front elevation thereof.
Figure 19:
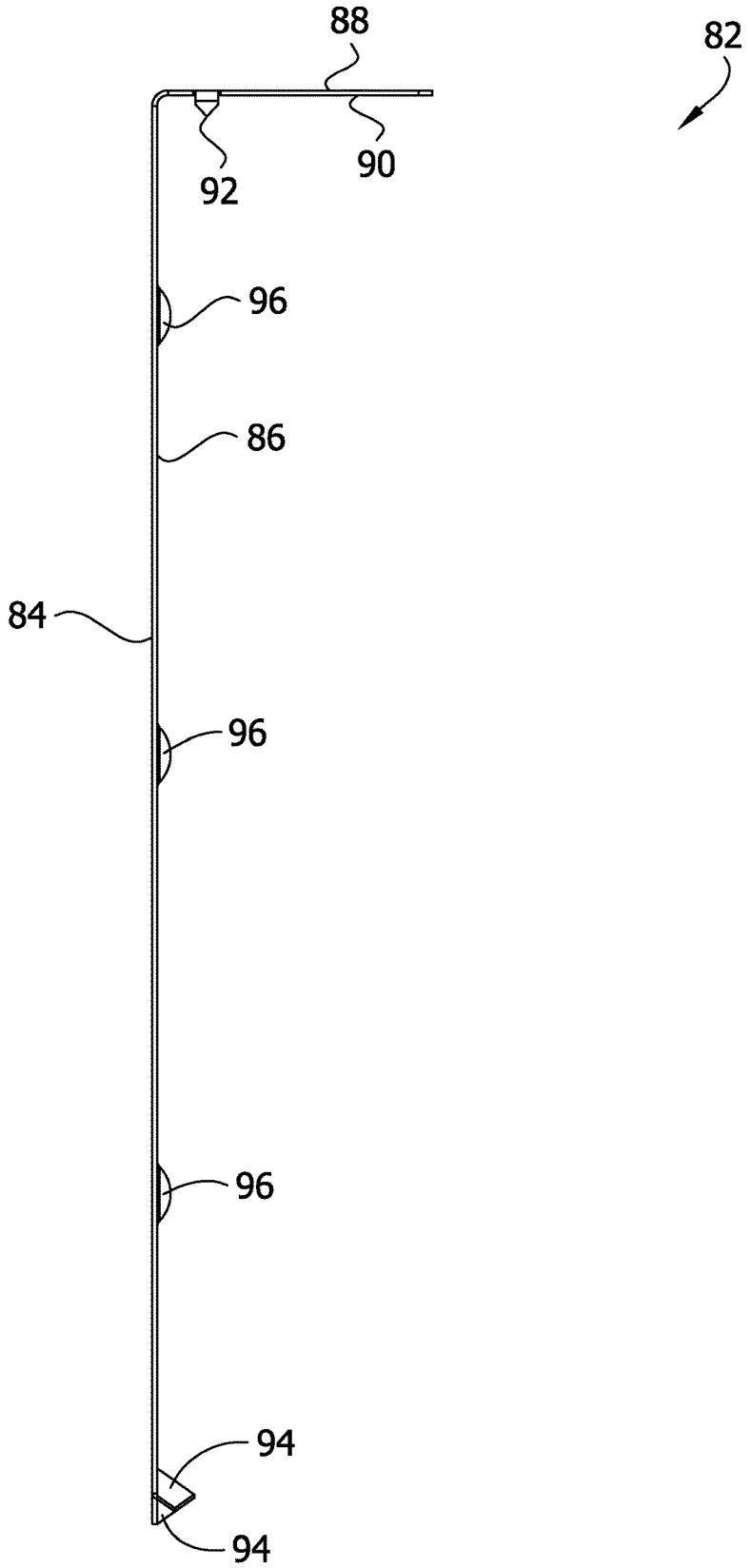
FIG. 19 is a right side elevation thereof.
Figure 20:
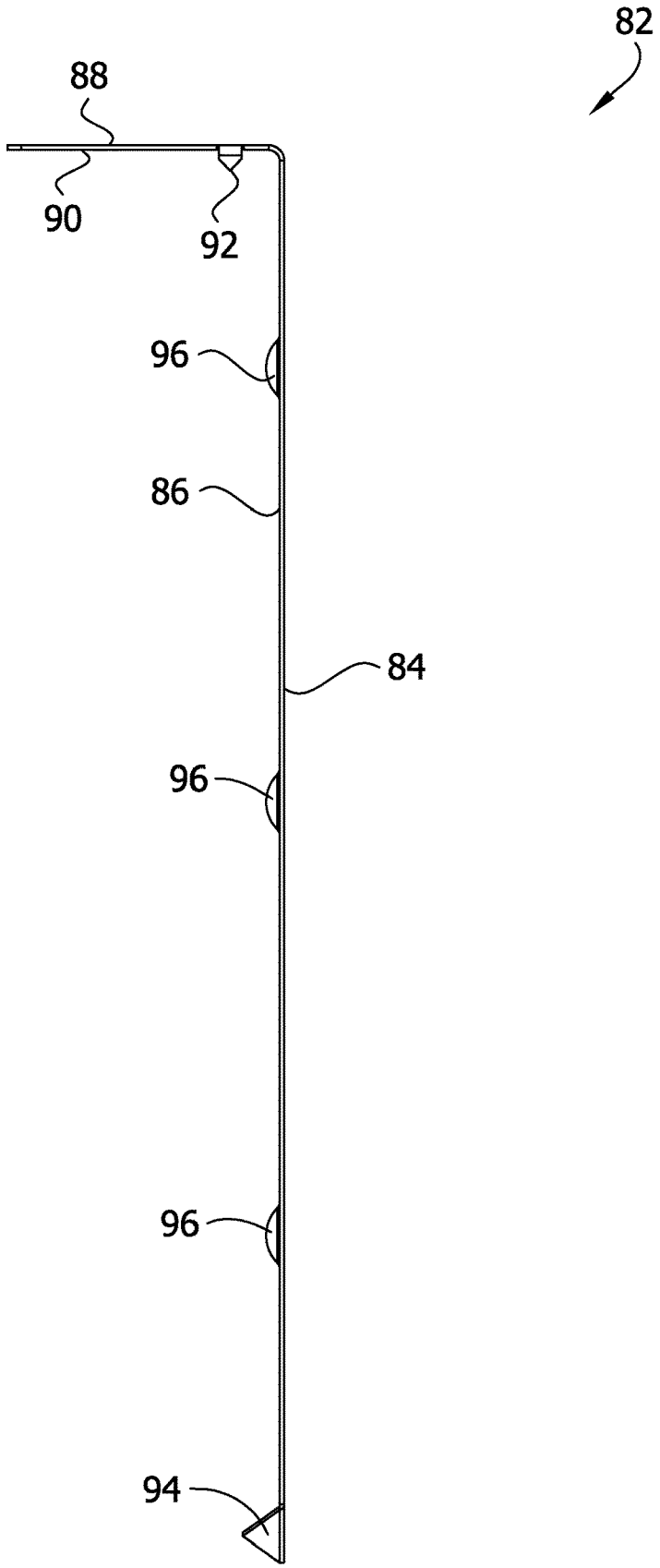
FIG. 20 is a left side elevation thereof.
Figure 21:
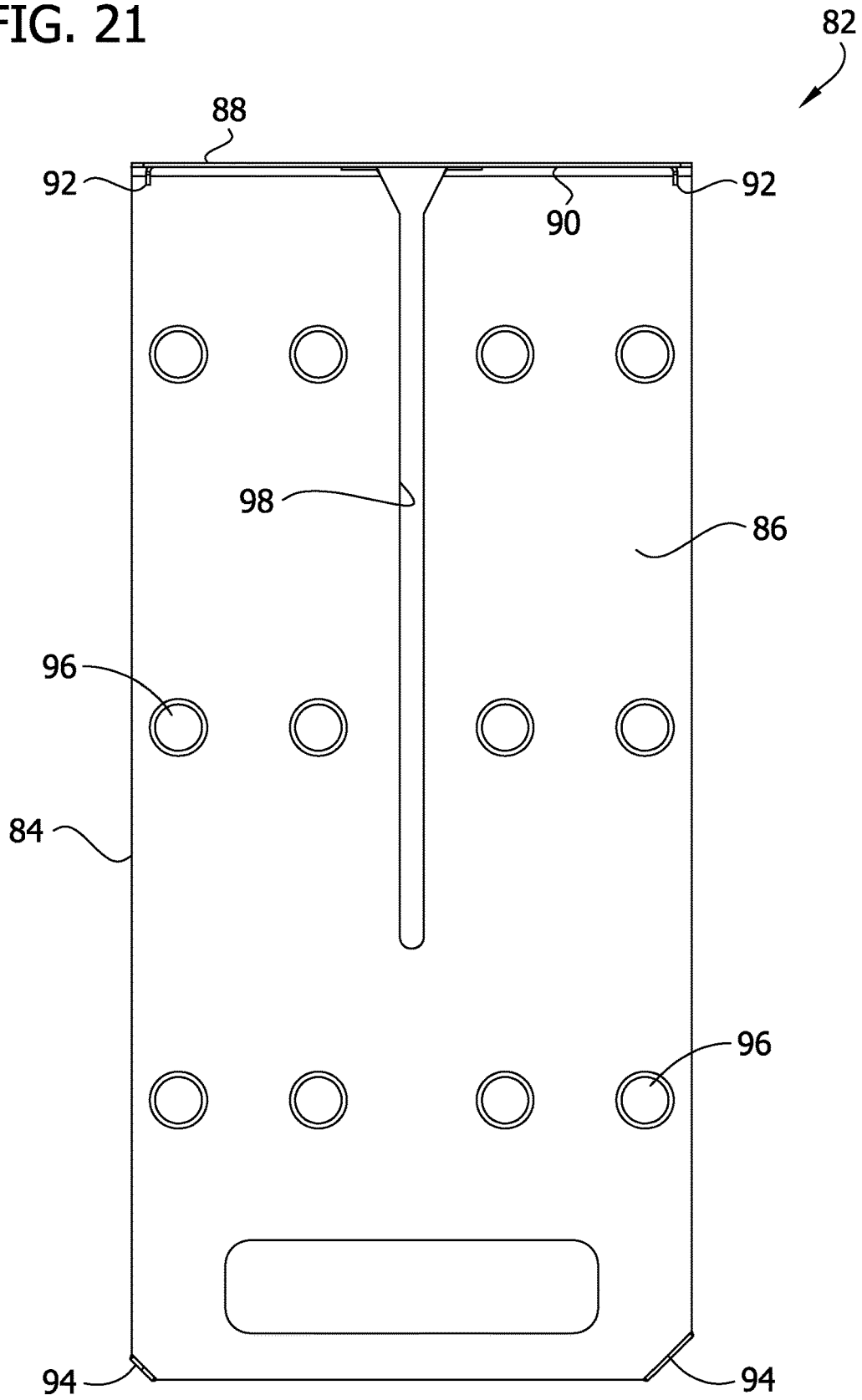
FIG. 21 is a rear elevation thereof.
Figure 22:
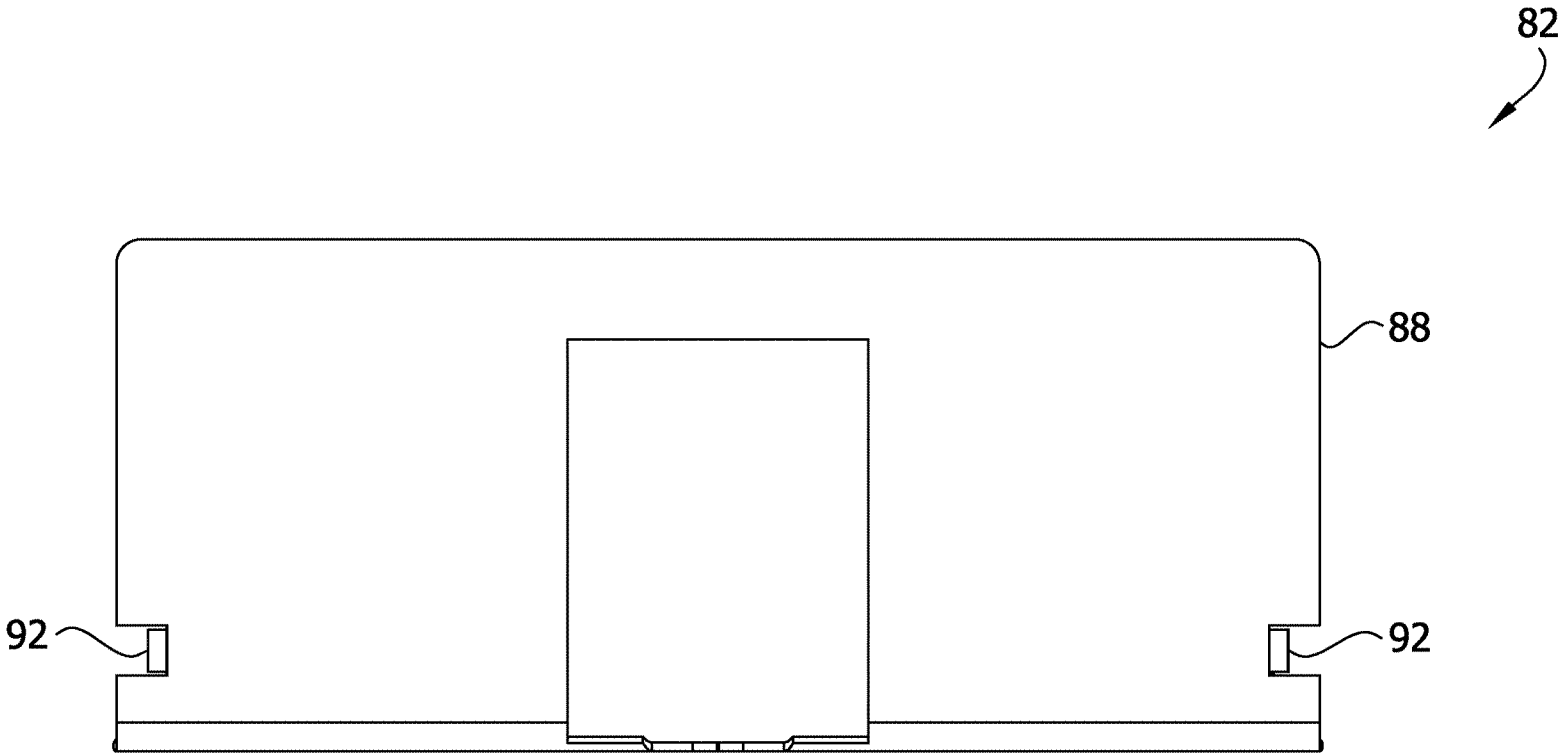
FIG. 22 is a top plan thereof.
Figure 23:
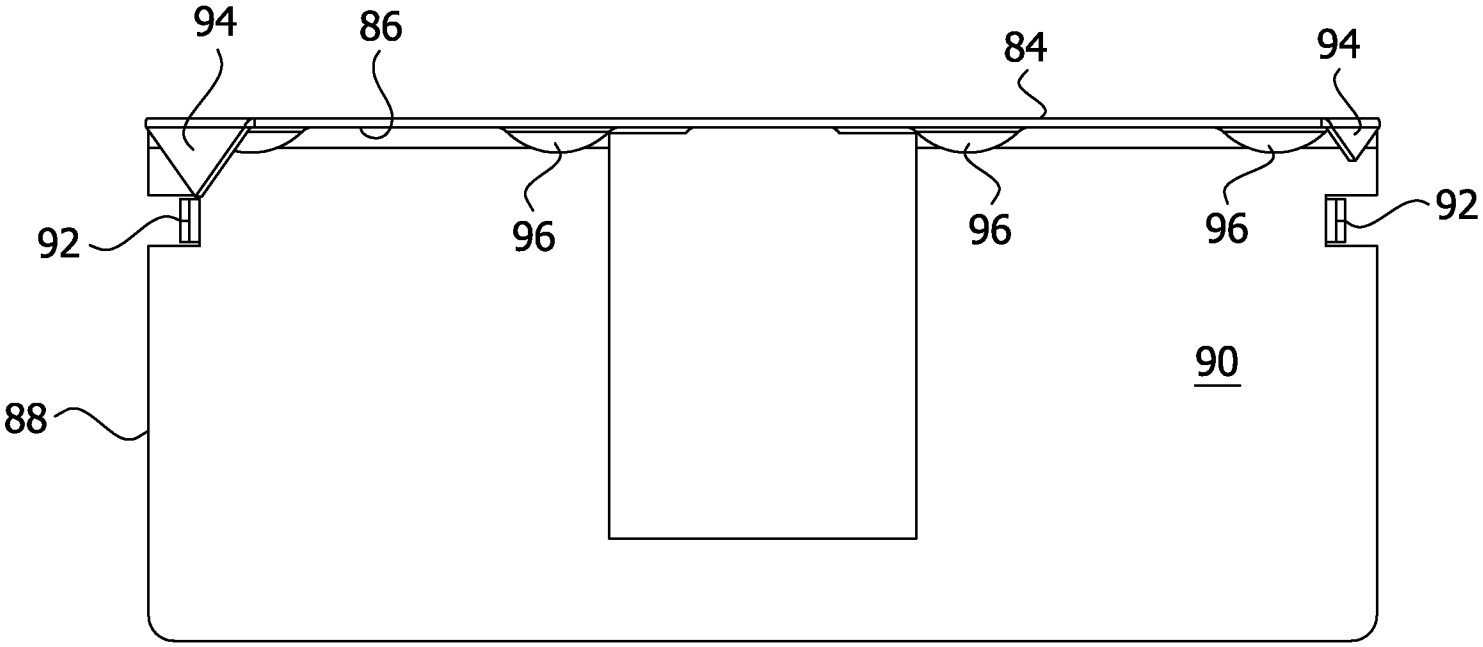
FIG. 23 is a bottom plan thereof.

As seen in FIG. 15, a truss hanger 26 as described above can be formed as one piece from a metal blank 80 that is stamped from a sheet metal roll and bent into shape. In one embodiment, the truss hanger 26 is stamped from 12-14 gauge steel, although other suitable materials are within the scope of the present invention. The configuration of the truss hanger 26 of the present invention allows a lighter gauge metal to be used.

In use, the truss hanger 26 is positioned in the slot 72 of the fire retardant sheathing 34 mounted on the wall 28. As seen in FIGS. 9-14A, one method of using the truss hanger 26 includes cutting the slot 72 in the fire retardant sheathing 34 (either before or after the sheathing is mounted on the wall). In one embodiment, the slot 72 can be cut using the slot template 82 (either before or after the sheathing 34 is mounted to the wall 28). The slot can be any suitable length, and in one embodiment is about 10 inches long. The truss hanger 26 is then positioned against the fire retardant sheathing 34 so that the extension flanges 60 extend through the slot 72. In one embodiment, the hanger 26 is slid downward into place so that the extension flanges 60 extend through the slot 72, the back flanges 66 are positioned adjacent the wall 28, and the fire retardant sheathing 34 is positioned in the sheathing channels 68 between the back flanges and the back panels 48. The hanger connector tabs 74 are fastened to the top plate 30 of the wall 28 by any suitable means, such as by inserting nail 78 through the nail holes 76. Then, a truss member, e.g. truss bottom chord 16, is positioned in the truss channel 52 of the hanger 26 (see FIG. 1), thereby securing the floor truss 12 to the wall 28. The truss hanger 26 is then fastened to the truss 12 by any suitable means, such as by inserting nails 56 through the nail holes 54 in each side panel 46 of the hanger. The hanger 26 is thus secured to both the truss 12 and the wall 28, with the fire retardant sheathing 34 secured between the hanger and the wall.

In another embodiment, the truss hangers 26 can be installed without pre-forming the slot 72 in the fire retardant sheathing 34. More particularly, each hanger 26 can be driven into the sheathing 34. The driving point 62 of the hanger 26 is positioned against a top edge of the fire retardant sheathing. The hanger 26 is then driven downward into the sheathing 34, led by the pointed tip 64. The hanger 26 continues to be driven into the gypsum boards until the connector tabs 74 engage the upper surface of the top plate 30. In this way, the hanger 26 forms the slot in the sheathing 34.

In still another embodiment, the truss hangers 26 can be installed on the wall 28 before the sheathing 34 is mounted on the wall. This simplifies construction by allowing the building to be completely framed and roofed before requiring the sheathing 34 to be installed. Trade workers (e.g., mechanical, electrical) therefore have complete access to the wall cavity to install components without interference from the sheathing 34. The truss hanger 26 is positioned against the wall 28 such that the back flanges 66 engage the wall and the connector tabs 74 engage the top plate 30. The connector tabs 74 are fastened to the top plate 30 of the wall by any suitable means, such as by inserting nails 78 through nail holes 76. Then, a truss 12 is positioned in the truss channel 52 of the hanger 26. The truss hanger is fastened to the truss 12 by any suitable means, such as by inserting nails 56 through the nail holes 54 in each side panel 46 of the hanger 26. The floor truss 12 is thereby secured to the hanger 26 and the wall 28, and access to the wall cavity remains unhindered by sheathing. Subsequently, the sheathing 34 can be mounted on the wall 28 by moving the sheathing upward into place so that the extension flanges 60 of the hanger 26 extend through the slot 72 of the sheathing and the sheathing is positioned in the sheathing channels 68 between the back flanges 66 and the back panels 48.

Referring to FIGS. 25-40, a second embodiment of a truss hanger 126 for use in mounting the floor truss 12 to the wall 28 is illustrated. The truss hanger 126 is similar to the truss hanger 26 described above, with differences as pointed out herein. Where the truss hanger 26 is configured for mounting the floor truss 12 generally orthogonal to the wall 28, the truss hanger 126 is configured for mounting the floor truss 12 in a skewed position relative to the wall.

Referring to FIGS. 26-33, the truss hanger 126 includes a channel-shaped portion 138, an extension portion 140, and a connection portion 142. The channel-shaped portion 138 is configured to receive the floor truss 12. The channel-shaped portion 138 is configured to support the floor truss 12 at a non-orthogonal angle relative to the wall 28. In this skewed embodiment, the channel-shaped portion 138 is offset from the extension portion 140. The channel-shaped portion 138 includes a seat or base 144 and a pair of side panels 146 extending upward from the base. When installed, the base 144 is generally horizontal, and the side panels 146 extend generally vertical from the base. A back panel 148 extends from one of the side panels 146*a* toward the opposing side panel 146*b*. The back panel 148 is generally perpendicular to both the side panels 146 and the base 144. When installed, the back panel 148 extends at a non-orthogonal angle (e.g., about 45°) to the interior face 50 of the fire retardant sheathing 34. The base 144, side panels 146, and back panel 148 form a channel 152 configured to receive the floor truss 12. Other configurations are within the scope of the present invention. For example, the truss hanger 126 can be configured to support the floor truss 12 at a range of different angles with respect to the wall 28.

Figure 25:
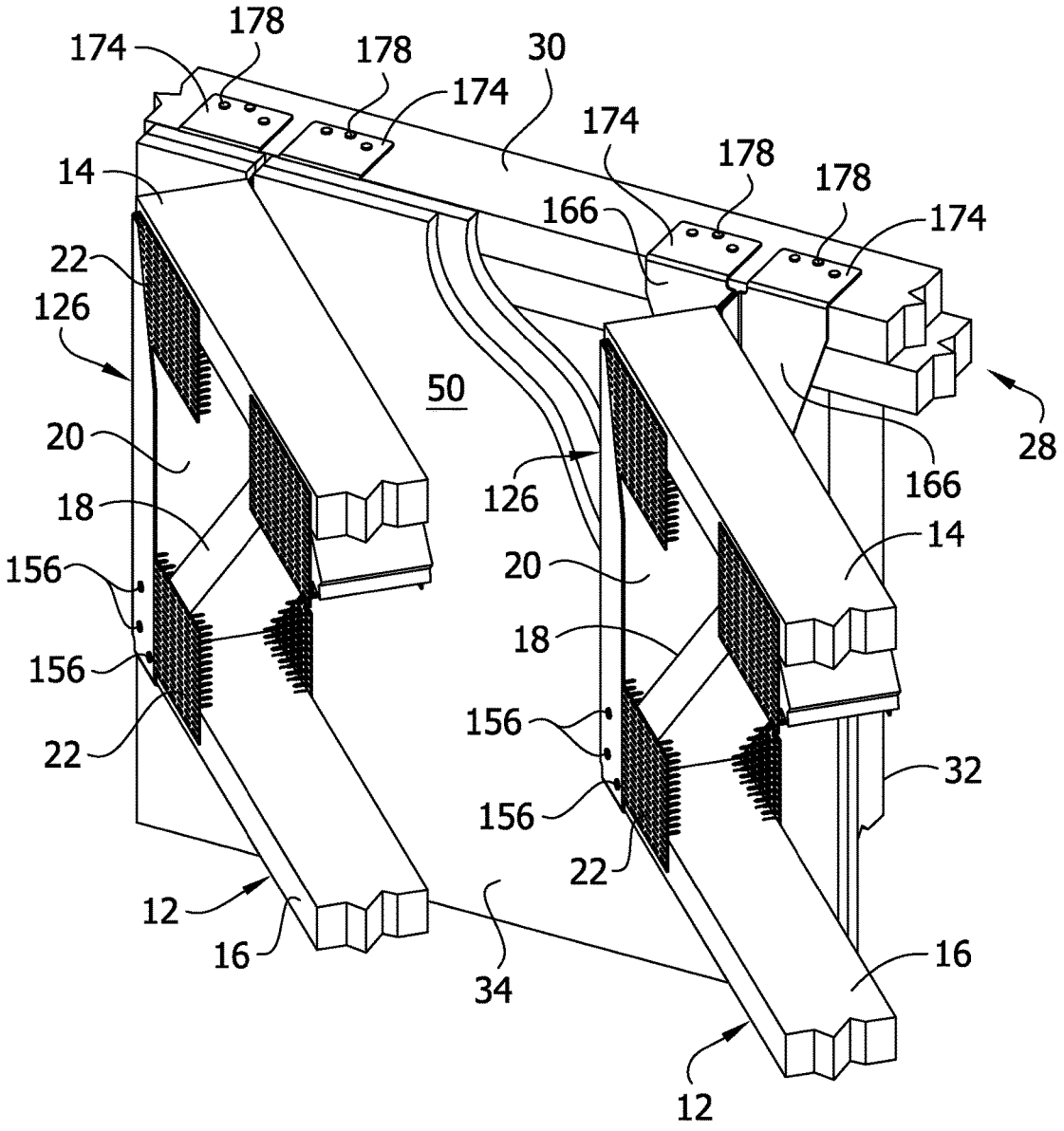
FIG. 25 is a fragmentary perspective of adjacent floor trusses connected at an angle to a wall having fire retardant sheathing by truss hangers of a second embodiment that extend through the sheathing.
Figure 26:
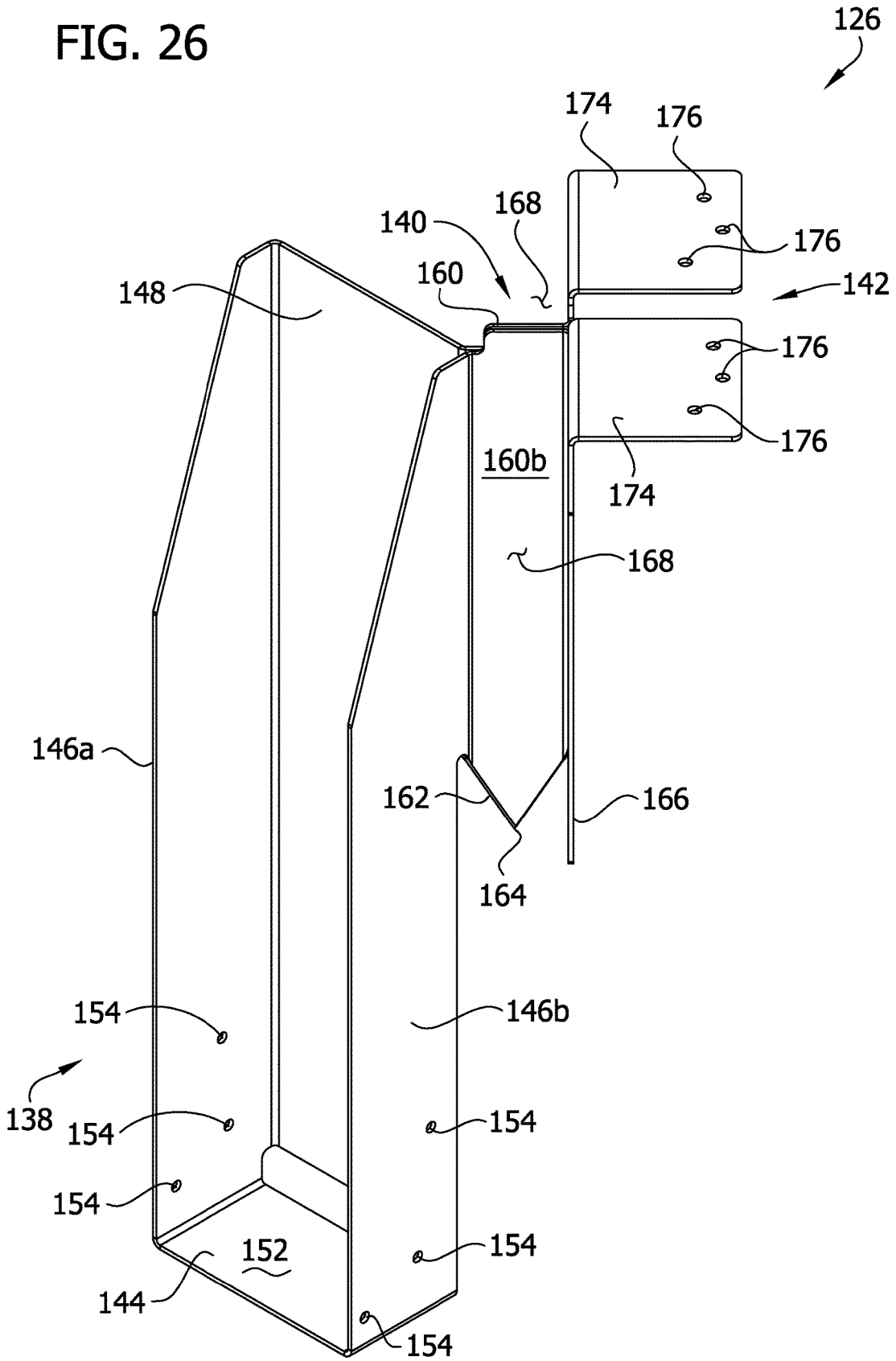
FIG. 26 is a perspective of one of the truss hangers of FIG. 25.
Figure 27:
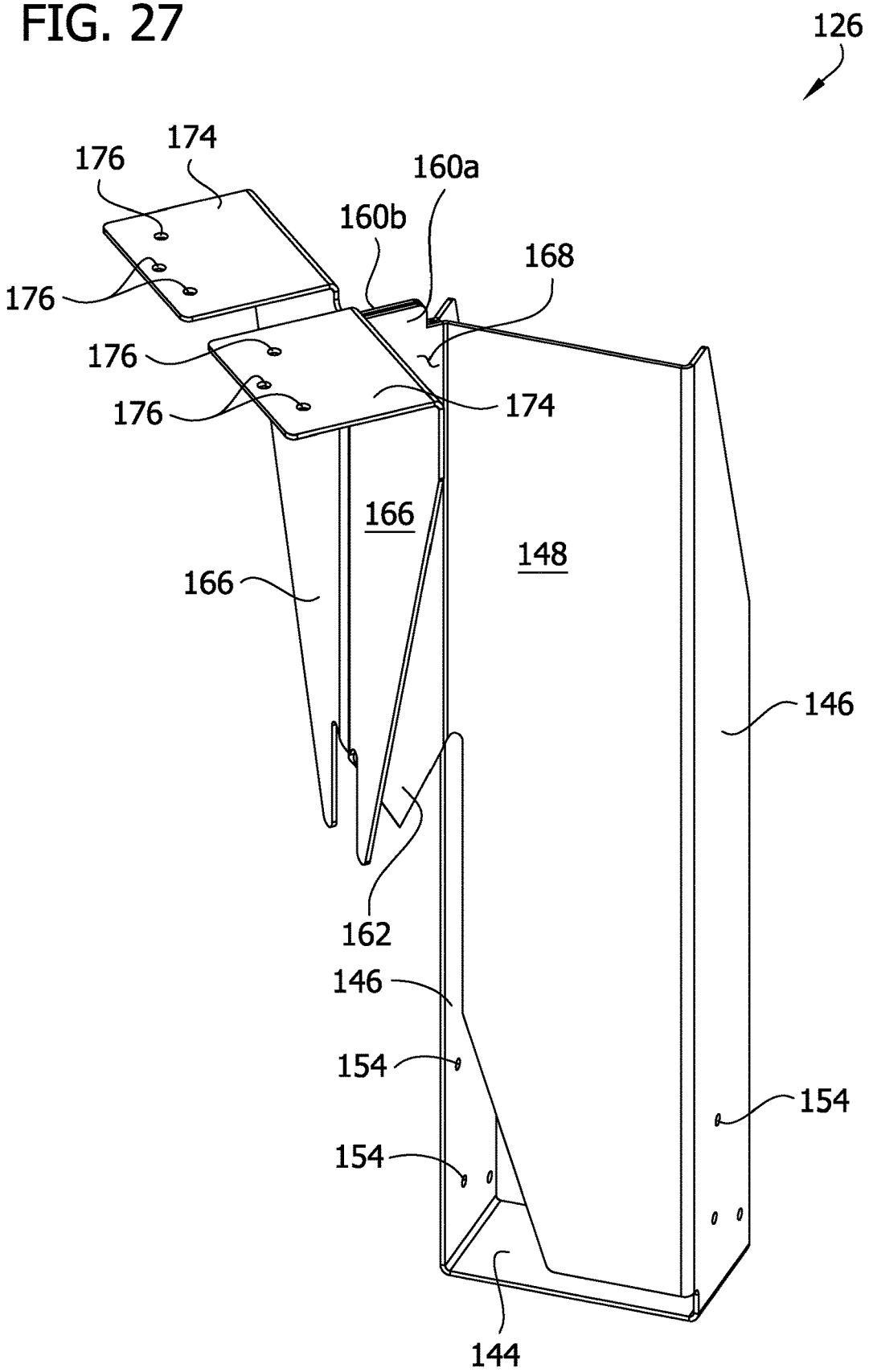
FIG. 27 is a rear perspective thereof.
Figure 39:
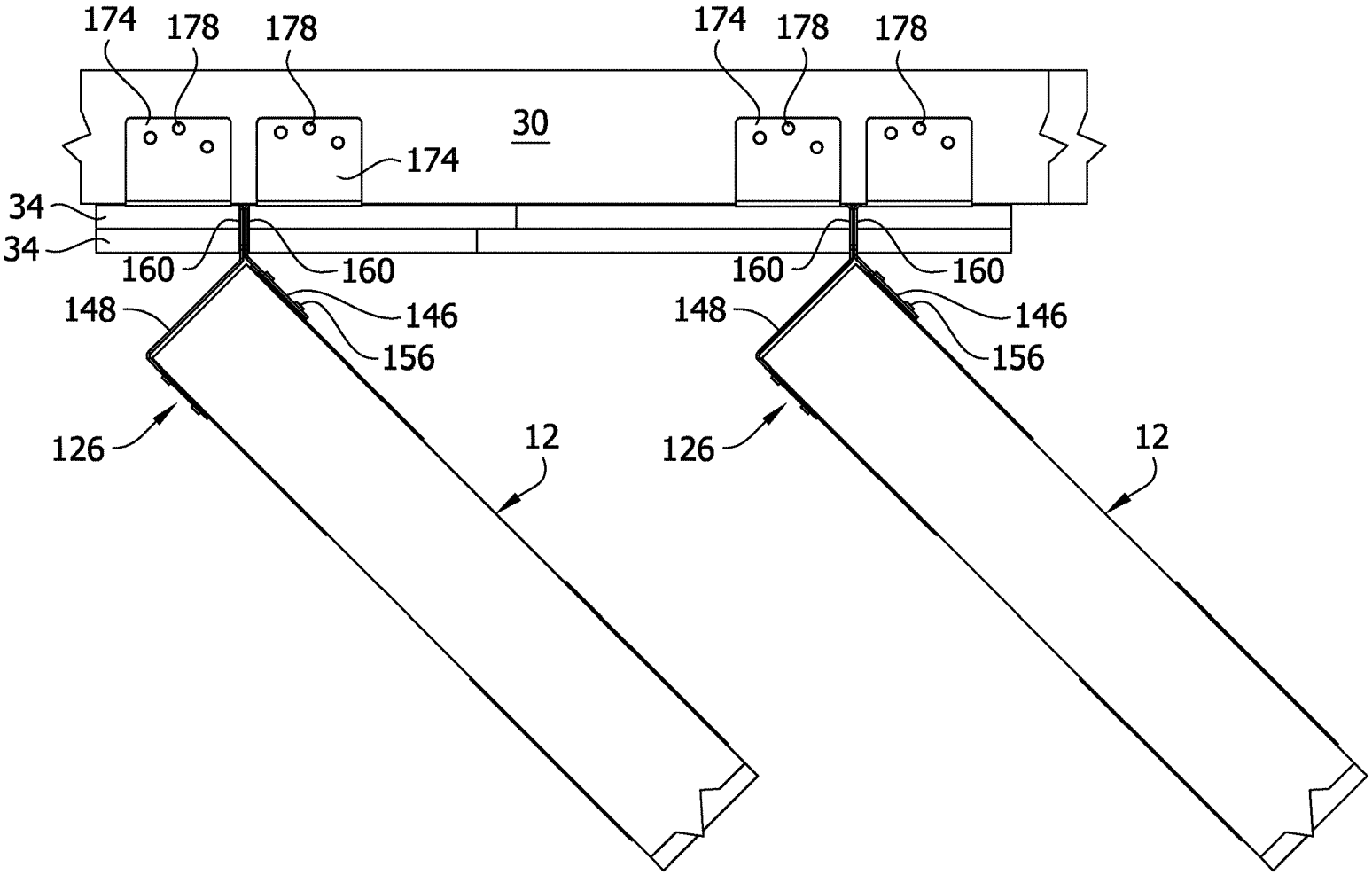
FIG. 39 is a top plan similar to FIG. 36, but showing a floor truss mounted in each truss hanger.

As seen in FIGS. 25 and 39, the floor truss 12 is received in the channel 152 to attach the floor truss to the wall 28 at a skewed angle. The bottom chord 16 of the floor truss 12 engages and rests upon (i.e., is supported by) the base 144. The end member 20 of the floor truss 12 is positioned against the back panel 148 between the side panels 146. The truss hanger 126 includes fastening structure for attaching the floor truss 12 to the truss hanger. Fastening structure can be of any type known in the art for attaching a connector to a wooden structural member, such as nailing teeth (not shown) struck from the material of the hanger. In the illustrated embodiment, the fastening structure comprises a hole to allow for insertion of a fastening member. More specifically, in one embodiment the fastening structure comprises nail holes 154 in the side panels 146 of the truss hanger 126 (see, FIG. 26), and the fastening member comprises a nail 156 (see, FIG. 25). In the illustrated embodiment, nail holes 154 are positioned on each of the side panels 146 so that nails 156 can be inserted into both the bottom chord 16 and the end member 20 of the floor truss 12 to attach the hanger 126 to the floor truss.

Figure 28:
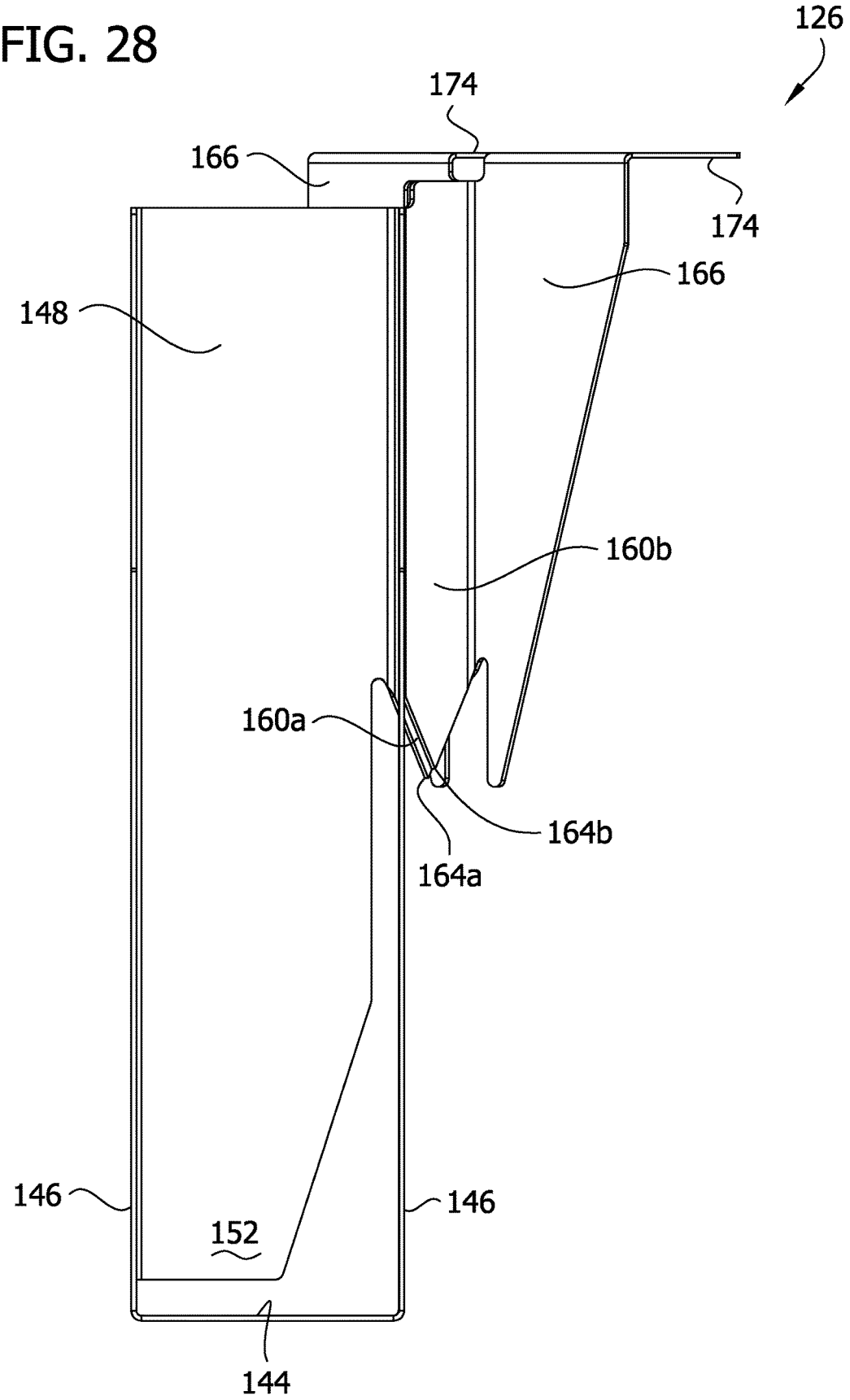
FIG. 28 is a front elevation thereof.
Figure 29:
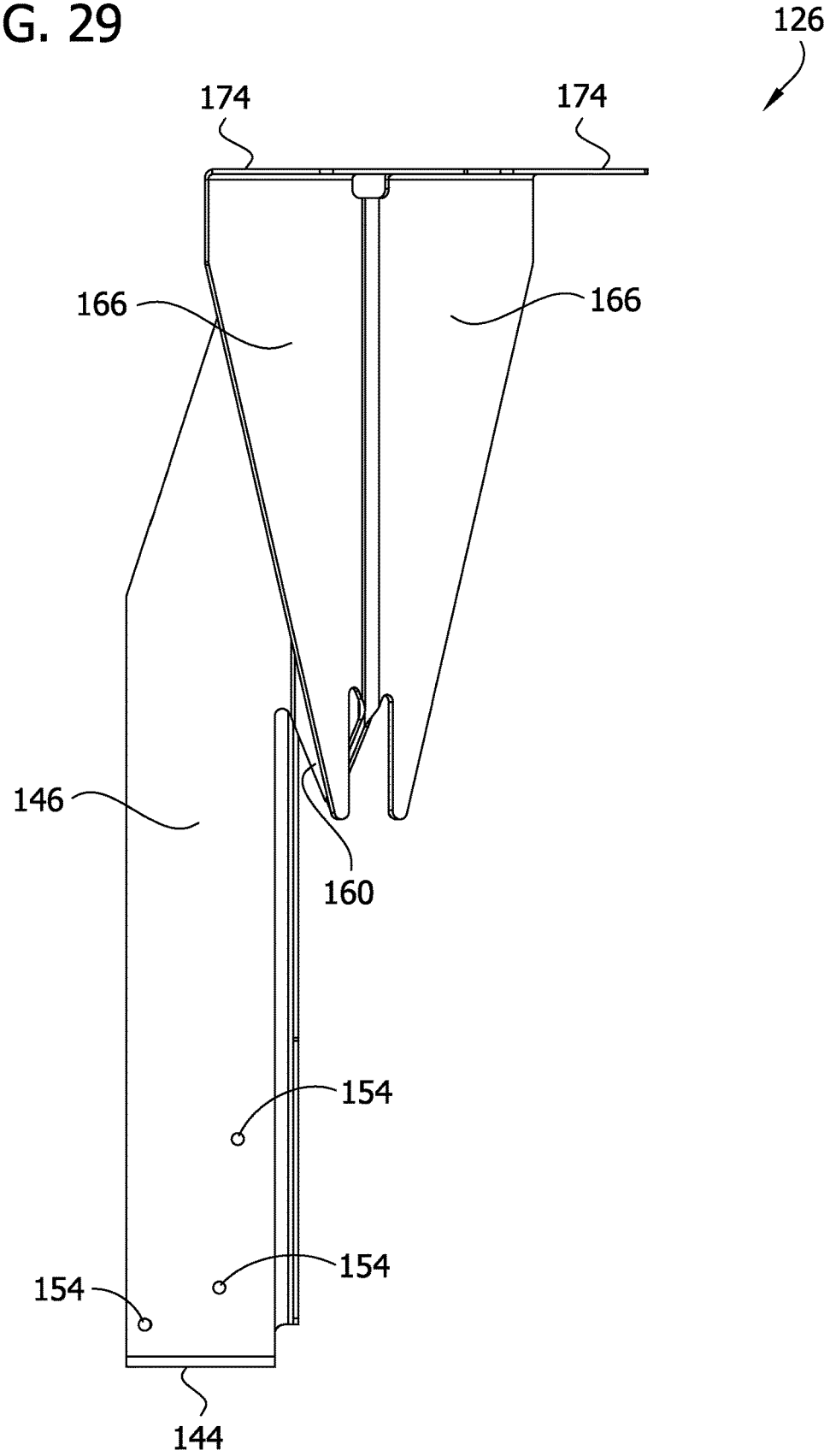
FIG. 29 is a right side elevation thereof.
Figure 30:
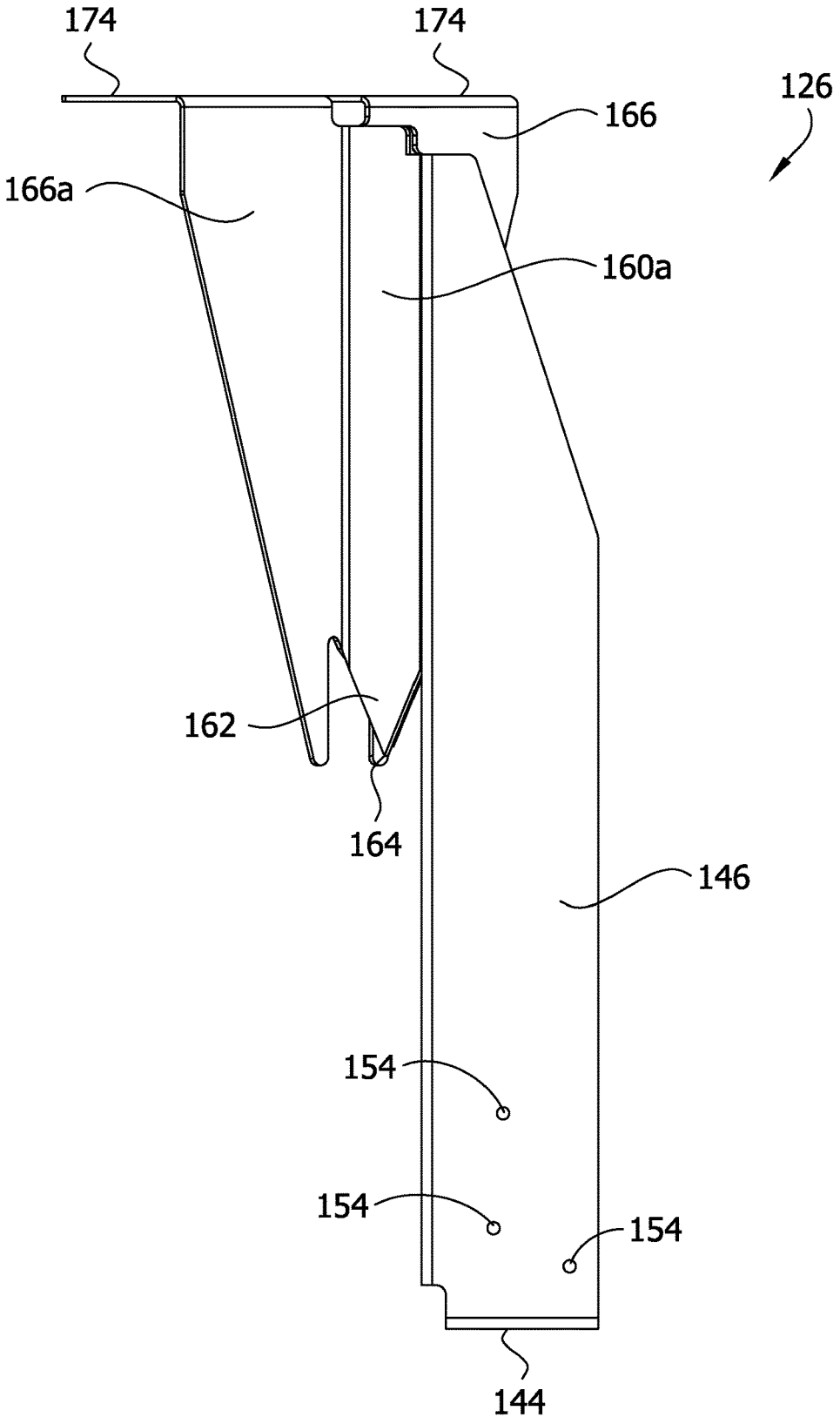
FIG. 30 is a left side elevation thereof.
Figure 31:
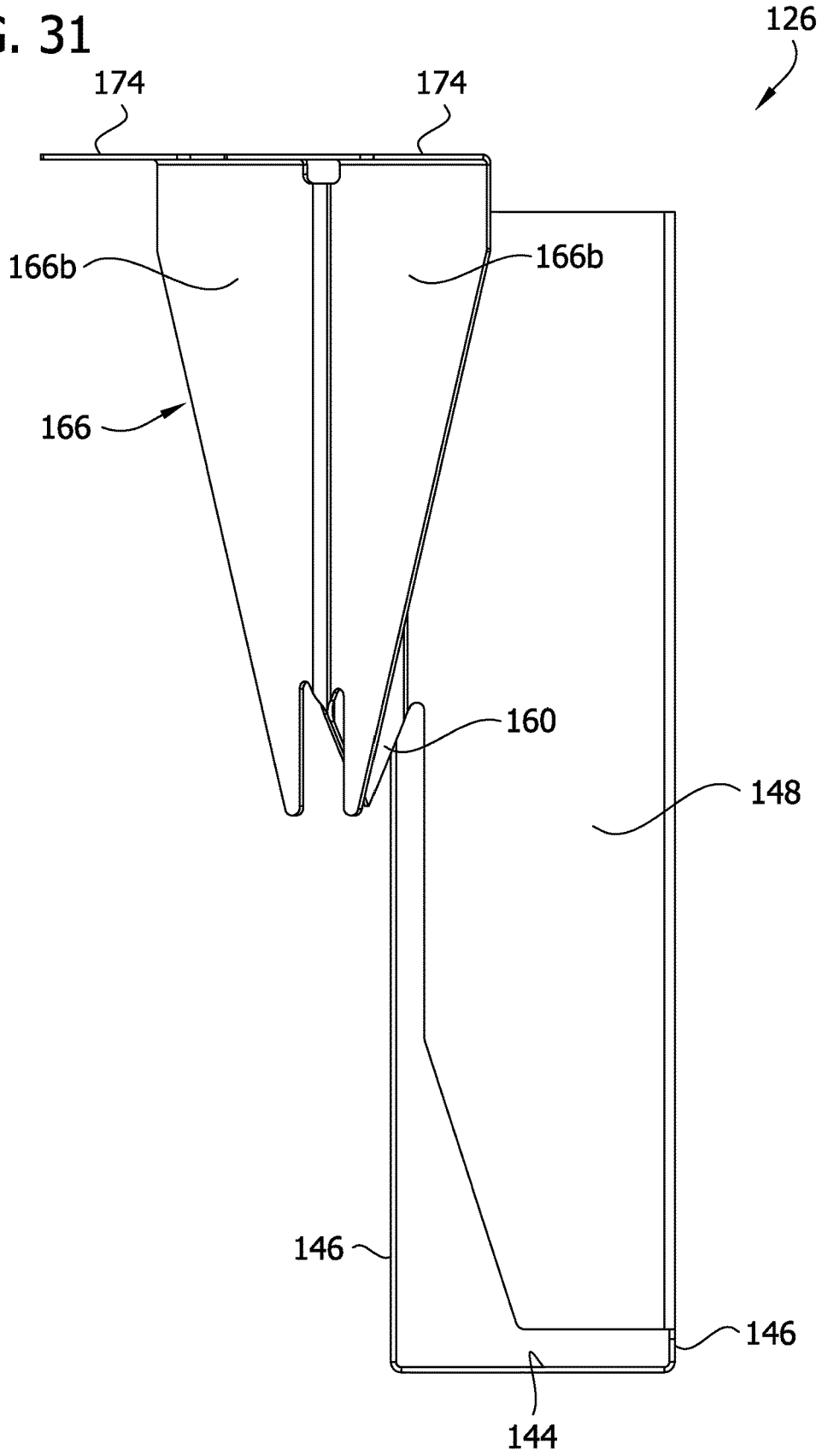
FIG. 31 is a rear elevation thereof.
Figure 32:
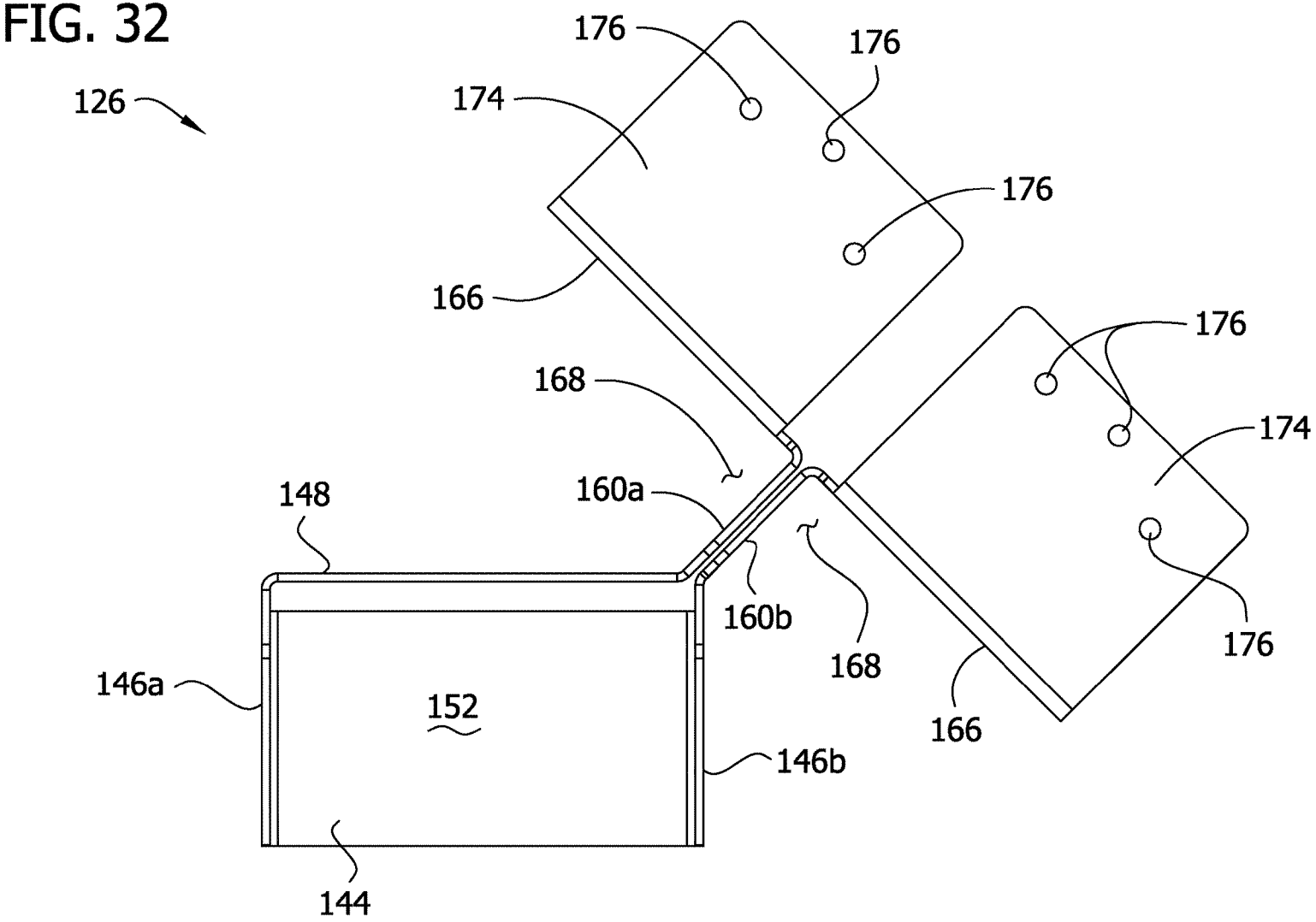
FIG. 32 is a top plan thereof.
Figure 33:
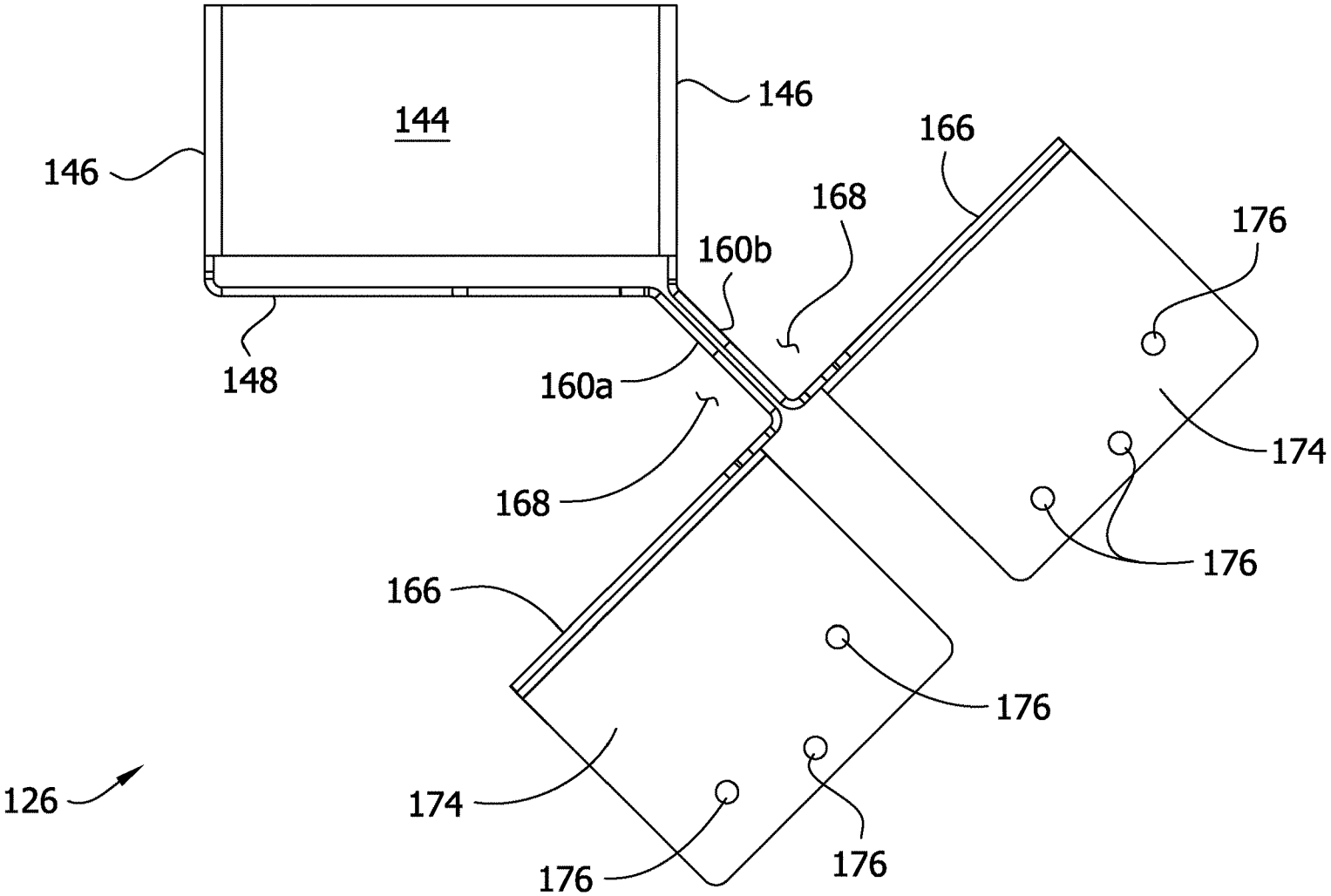
FIG. 33 is a bottom plan thereof.

Referring again to FIGS. 26-33, the extension portion 140 includes two extension flanges 160 configured to extend through the fire retardant sheathing 34. One of the flanges 160*a* extends from the back panel 148. The other flange 160*b* extends from the side panel 146*b*. The flanges 160 are positioned in opposed, face-to-face relation, and preferably engage each other along a juncture. At a bottom edge, each flange 160 includes a driving point 162. Each of the driving points 162 is generally triangular and includes a pointed tip 164. As seen in FIG. 28, the tips 164 of the driving points 162 are vertically offset from each other. As illustrated, the tip 164*a* of one flange 160*a* extends vertically below the tip 164*b* of the other flange 160*b*. In one embodiment, the tips 164 are vertically offset from each other about ⅛", although other configurations are within the scope of the present invention, such as tips that are aligned or tips that are offset a smaller or larger amount.

Figure 38:
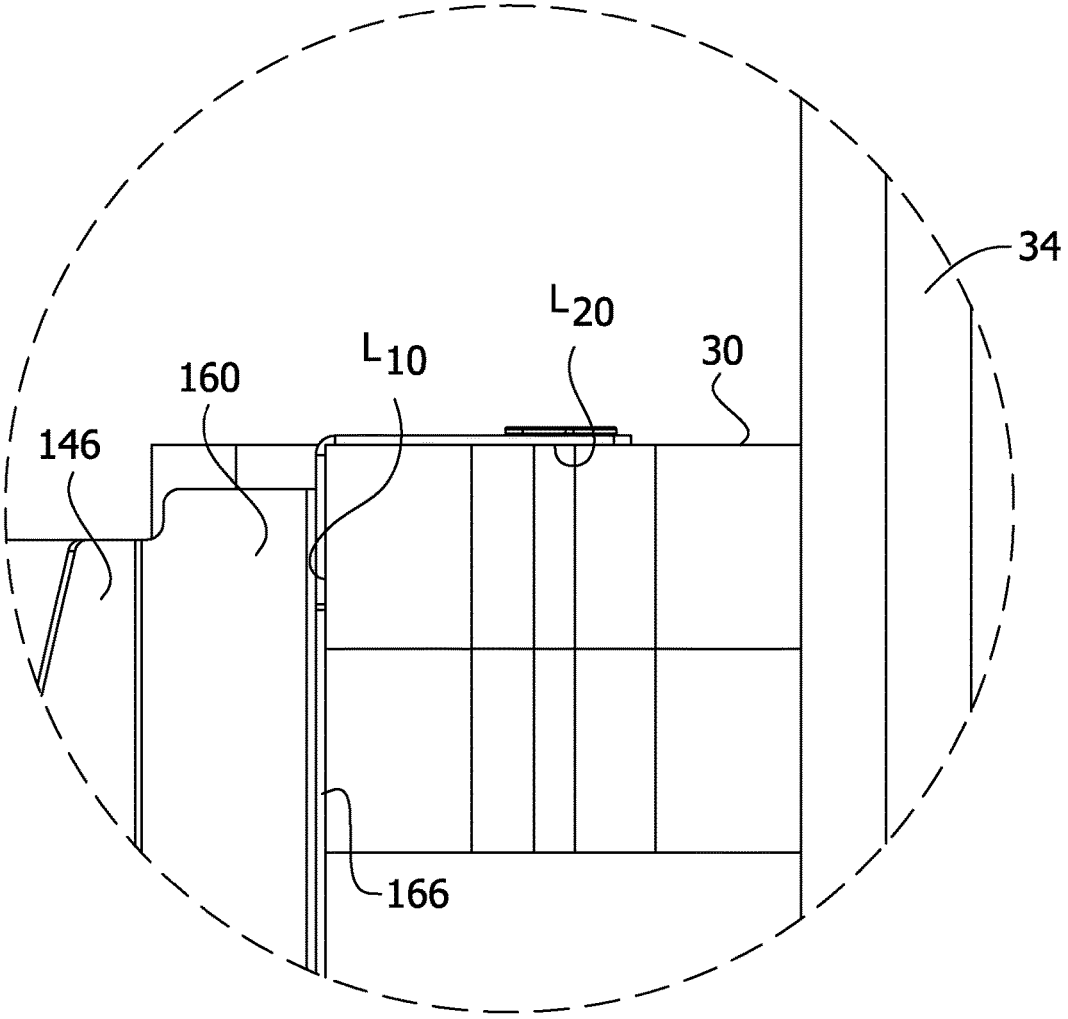
FIG. 38 is an enlarged fragment of FIG. 37.

A back flange 166 extends from the extension flange 160 generally perpendicular from the extension flange. Referring to FIG. 38, the back flange 166 engages the wall 28 at a first location $L_{10}$, which in the illustrated embodiment is a vertical face of the top plate 30 of the wall behind the fire retardant sheathing 34. The back flange 166 comprises a back flange portion 166*a* bent from the extension flange 160*a* and a back flange portion 166*b* bent from the extension flange 160*b*. The back panel 148, side panel 146*b*, extension flanges 160, and back flange 166 form a pair of sheathing channels 168 (see, FIG. 32). Each sheathing channel 168 is configured to receive a portion of the fire retardant sheathing 34.

Figure 34:
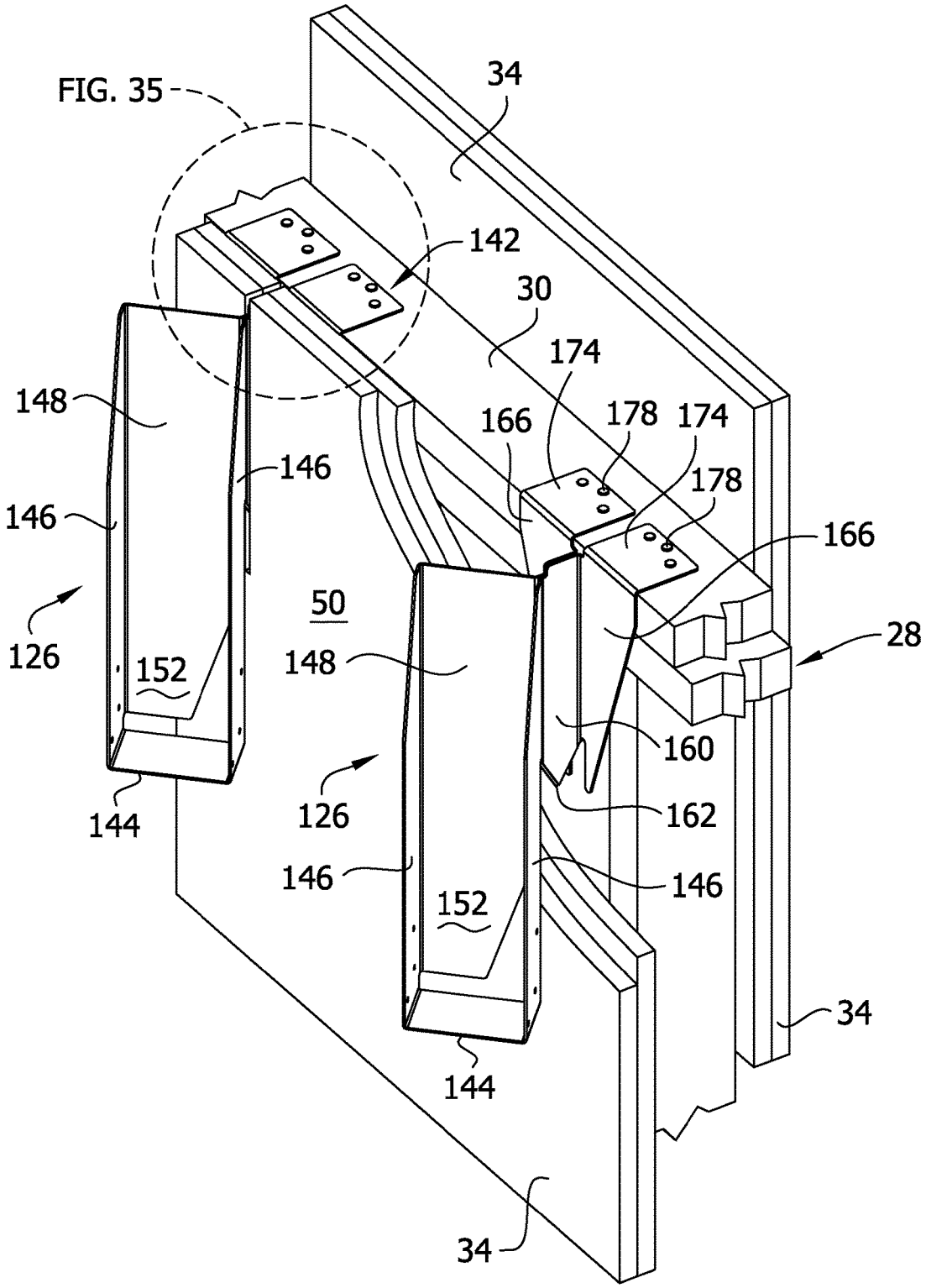
FIG. 34 is a perspective of a wall and the two truss hangers mounted thereon with parts broken away.
Figure 35:
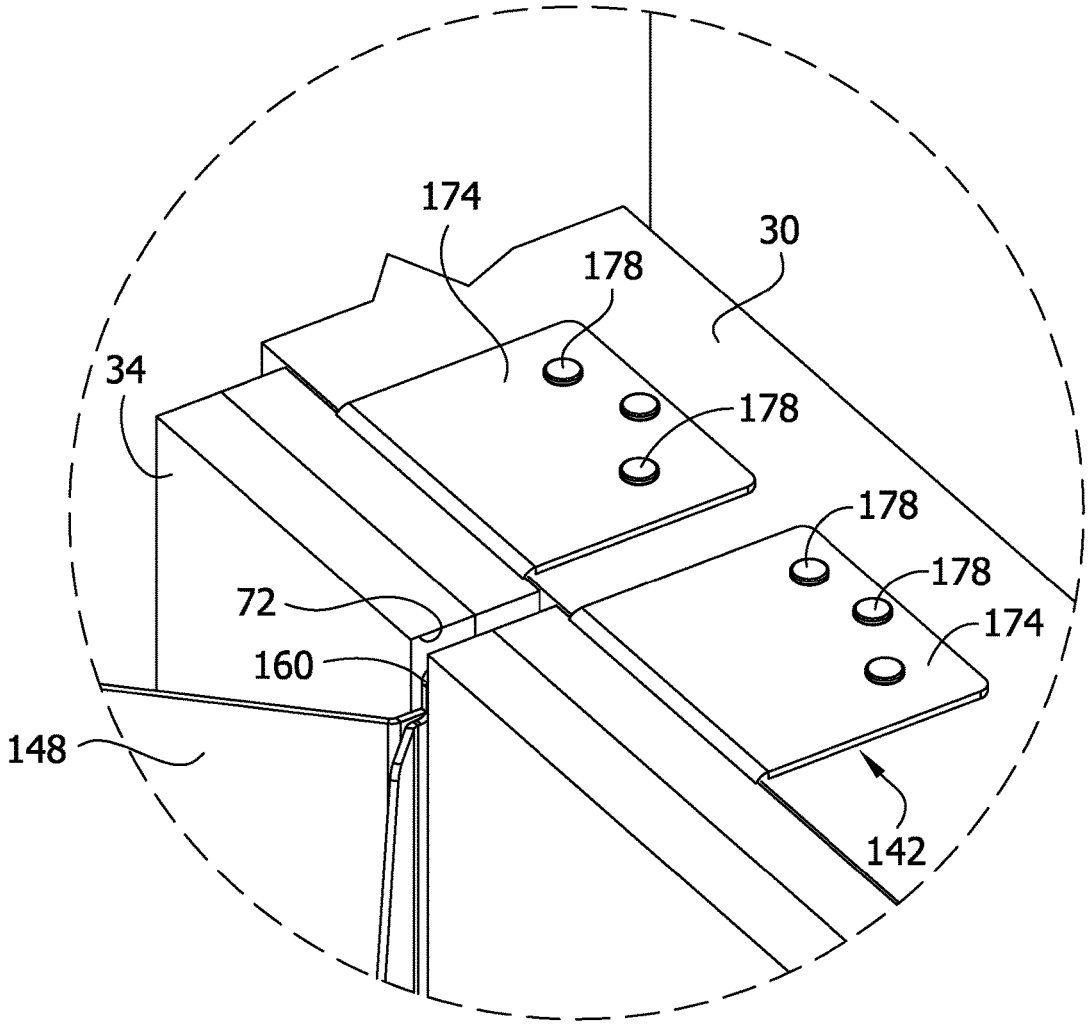
FIG. 35 is an enlarged fragmentary perspective of FIG. 34.
Figure 36:
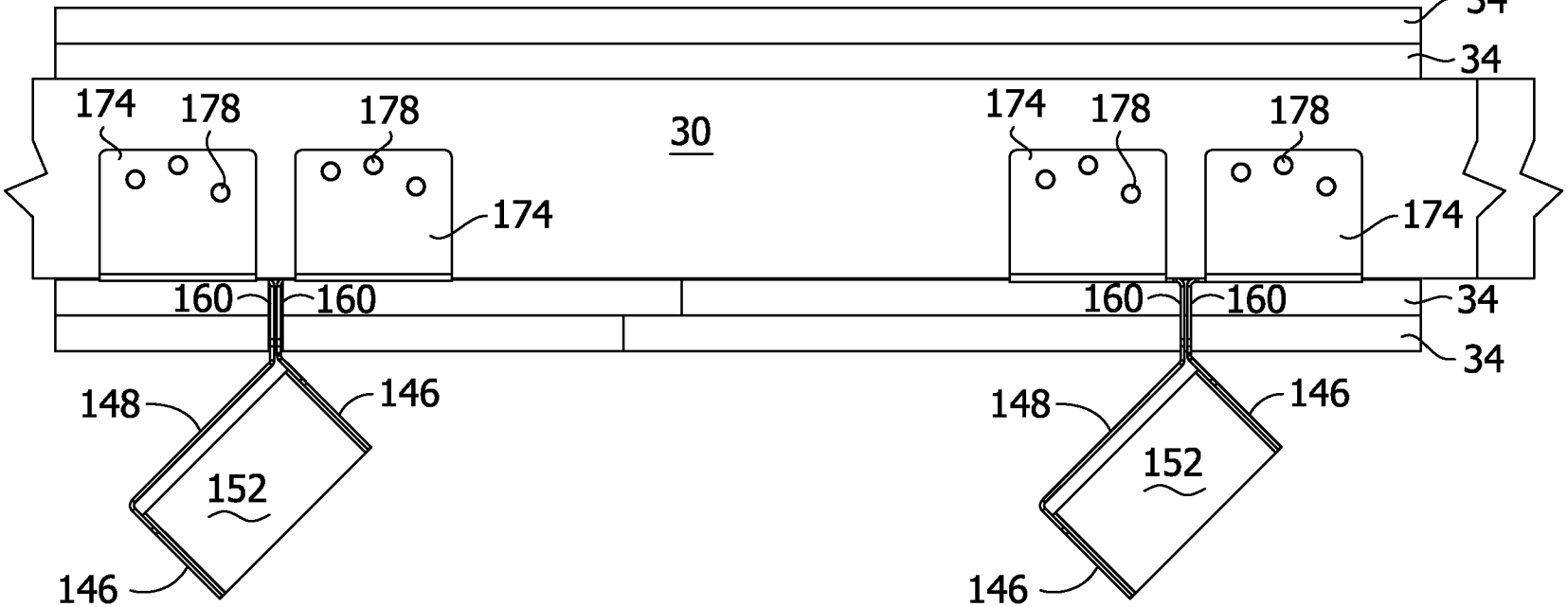
FIG. 36 is a top plan of FIG. 34, illustrating the truss hangers extending through the fire retardant sheathing.
Figure 37:
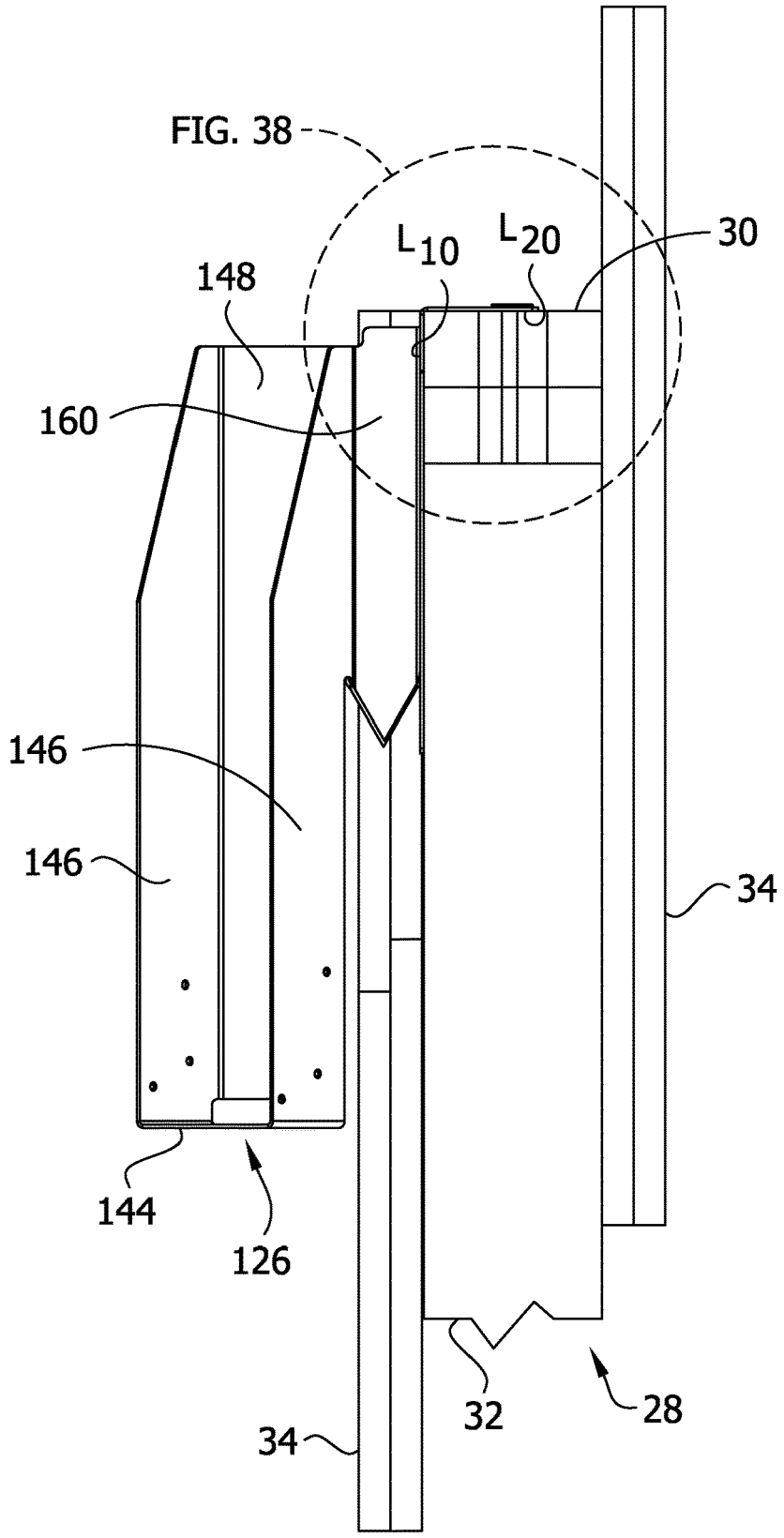
FIG. 37 is a side elevation of FIG. 34.

As seen in FIGS. 34-36, the extension flanges 160 extend through the slot 72 in the fire retardant sheathing 34. Preferably, the slot has an area less than or equal to 6 square inches, and the gap between the extension flanges 60 and the edge of the slot 72 is less than or equal to ⅛". The driving points 162 extend down into the sheathing 34 to engage the sheathing and further secure the sheathing between the hanger 126 and the wall 28. A portion of the fire retardant sheathing 34 extends into each sheathing channel 168 and is secured against the back flange 166.

Referring again to FIGS. 26-33, the connection portion 142 of the hanger 126 includes a pair of connector tabs 174 extending from the back flange portions 166*a*, 166*b*. Each connector tab 174 extends generally perpendicular from a respective one of the back flanges 166*a*, 166*b*. The connector tabs 174 are generally horizontal when the hanger 126 is installed. The connector tabs 174 are configured to overlie and engage an upper surface of the top plate 30 of the wall 28 at a second location $L_{20}$ spaced from the first location $L_{10}$ (see, FIGS. 37 and 38). The connector tabs 174 can be used to attach the truss hanger 126 to the wall 28, thereby hanging the floor trusses 12 from the wall. As seen in FIG. 25, the connector tabs 174 extend over a portion of the top plate 30 of the wall 28. Each connector tab 174 includes fastening structure, such as nail holes 176, for insertion of a fastening member, such as nails 178 (see FIGS. 34 and 35), to attach the hanger 126 to the wall 28. In the illustrated embodiment, each connector tab 174 includes three nail holes 176. Other configurations are within the scope of the present invention, such as a different number of nail holes, or alternate fastening structure such as nailing teeth or other appropriate structure for fastening the hanger to the wall.

The base 144 and back flanges 166 cooperate to stabilize the truss hanger 126 and protect the fire retardant sheathing 34 from exposure to the loads transferred from the truss 12 to the wall 28 by way of the truss hanger 126. The channel 152 that receives an end portion of the truss 12 is spaced to the interior of the wall 28 and more particularly to the interior of the second location $L_{20}$ where the connector tabs 174 are attached to an upper surface of the top plate 30 (see FIG. 38). The vertically downward load of the truss 126 applied to the base 144 of the truss hanger 126 urges the truss hanger to pivot so that the base would move toward the wall 28, which could damage the fire retardant sheathing 34 and pry out the nails 178 connecting the connector tabs 174 to the upper surface of the top plate 30. However, this motion is resisted by the engagement of the back flanges 166 with the interior vertical face of the top plate 30 at the first location $L_{10}$. Thus, there is a force couple between the base 144 and back panel 148 of the hanger 126 (via engagement of the back flanges 166 with the top plate 30) engaging the end fact of the truss. Accordingly, the truss hanger 126 and truss 12 are stable with minimal disruption of the fire retardant sheathing 34, even though the truss is held at a distance from the wall 28.

Figure 40:
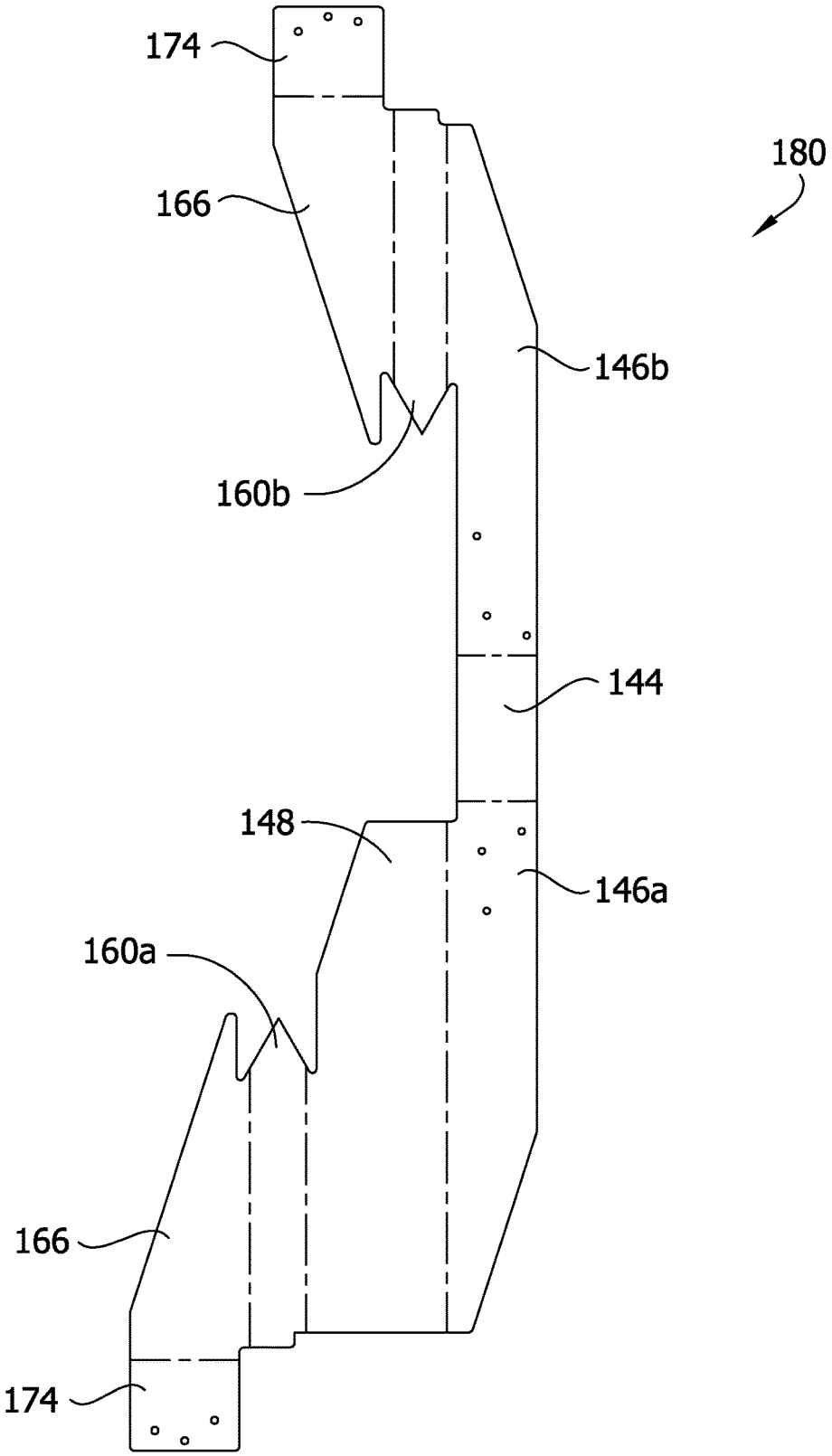
FIG. 40 is a front view of a stamped metal blank for forming a truss hanger according to the present invention.

As seen in FIG. 40, a truss hanger 126 as described above can be formed as one piece from a metal blank 180 that is stamped from a sheet metal roll and bent into shape. Parts of the blank 180 are labelled with reference numerals corresponding to the various parts of the formed truss hanger 126. In one embodiment, the truss hanger 126 is stamped from 12-14 gauge steel, although other suitable materials are within the scope of the present invention. The configuration of the truss hanger 126 of the present invention allows a lighter gauge metal to be used.

The truss hanger 126 is used as described above with reference to the truss hanger 26. In use, the truss hanger 126 is positioned in the slot 72 of the fire retardant sheathing 34 mounted to the wall 28. One method of using the truss hanger 126 includes cutting the slot 72 in the fire retardant sheathing (either before or after the sheathing is mounted on the wall). In one embodiment, the slot 72 can be cut using the slot template 82 (either before or after the sheathing 34 is mounted to the wall 28). The slot 72 can be any suitable length, and in one embodiment is about 10 inches long. The truss hanger 126 is then positioned against the fire retardant sheathing 34 so that the extension flanges 160 extend through the slot 72. In one embodiment, the hanger 126 is slid downward into place so that the extension flanges 160 extend through the slot 72, the driving point 162 engages the fire retardant sheathing 34, the back flange 166 is positioned adjacent the wall 28, and the fire retardant sheathing is positioned in the sheathing channels 168 of the hanger. The hanger connector tabs 174 are fastened to the top plate 30 of the wall 28 by driving nails 178 through the nail holes 176 into the top plate 30. Then, a truss member, e.g. truss bottom chord 16 is positioned in the truss channel 152 of the hanger 126. Nails 156 are driven through holes 154 in the side panels 146 to secure the floor truss 12 to the wall 28. The hanger 126 is thus secured to both the truss 12 and the wall 28, with the fire retardant sheathing 34 between the hanger and the wall.

In another embodiment, the truss hangers 126 can be installed without pre-forming the slot 72 in the fire retardant sheathing 34. More particularly, each hanger 126 can be driven into the sheathing 34. The pointed tip 164 of the driving point 162 of the hanger 126 is positioned against a top edge of the fire retardant sheathing 34. The hanger 126 is then driven downward into the sheathing 34, led by the pointed tip 164. The hanger 126 continues to be driven into the gypsum boards until the connector tabs 174 engage the upper surface of the top plate 30. In this way, the hanger 126 forms the slot in the sheathing 34.

In another embodiment, the truss hangers 126 can be installed on the wall 28 before the sheathing 34 is mounted on the wall. This simplifies construction by allowing the building to be completely framed and roofed before requiring the sheathing 34 to be installed. Trade workers (e.g., mechanical, electrical) therefore have complete access to the wall cavity to install components without interference from the sheathing 34. The truss hanger 126 is positioned against the wall 28 such that the back flange 166 engages the wall and the connector tabs 174 engage the top plate 30. The connector tabs 174 are fastened to the top plate 30 of the wall by any suitable means, such as by inserting nails 178 through nail holes 176. Then, a truss 12 is positioned in the truss channel 152 of the hanger 126. The truss hanger 126 is fastened to the truss 12 by any suitable means, such as by inserting nails 156 through the nail holes 154 in each side panel 146 of the hanger. The floor truss 12 is thereby secured to the hanger 126 and the wall 28, and access to the wall cavity remains unhindered by sheathing. Subsequently, the sheathing 34 can be mounted on the wall 28 by moving the sheathing upward into place so that the extension flanges 160 of the hanger 126 extend through the slot 72 of the sheathing and the sheathing is positioned in the sheathing channels 168 of the hanger.

The truss hanger 26, 126 permits a floor truss 12 to be secured to a wall 28 through fire retardant sheathing 34 with minimal interruption to the sheathing. Installation of the truss hanger minimally disrupts the continuity of the sheathing and therefore does not reduce the fire resistive rating of a fire rated assembly. The extension flanges 60, 160 extend through the fire retardant sheathing 34 so that the sheathing is interrupted only by the slot 72 required to receive the flanges. The back flanges 66, 166 engage the wall 28 behind the sheathing 34 to stabilize the hanger 26, 126 and protect the sheathing. The truss hanger 26, 126 can be mounted on a wall already having sheathing mounted thereon, or can be mounted on a wall before the sheathing (i.e., the sheathing does not have to be mounted on the wall before the truss hanger), thereby simplifying construction. The truss hanger 26, 126 can be formed from a metal blank 80, 180, which reduces the number of parts required to hang the floor truss 12 and simplifies the manufacturing process.

In an independent test performed by an outside firm, the truss hanger was installed as part of a wall assembly including 2×6 wood studs, 24" on center, with two layers of ⅝" Type X gypsum attached to each side. The gypsum board included a slot to accommodate the hanger. The hanger was fixed to the top plate of the wall with six 10d common nails in the connector tabs. The cavities in the wall were filled with mineral wool insulation. The testing was performed per ASTM E814 which subjected the specimen to the time/temperature curve prescribed in ASTM E119 for a period of two hours, followed by a hose stream test. As a result of this testing, the outside firm reported that when installed on one side of a maximum 2 hour fire-rated wall assembly, the penetration of the truss hanger through the gypsum board will not reduce the fire resistive rating of the 2 hour fire resistive assembly.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A hanger for connecting a structural component to a wall adapted to have sheathing mounted thereon, the hanger comprising:

a channel-shaped portion configured to receive the structural component;

an extension portion extending from the channel-shaped portion and configured to extend through the sheathing to engage the wall at a first location, the extension portion including extension flanges extending from the channel-shaped portion, each of the extension flanges being configured to extend through the sheathing; and a connection portion configured for attachment to the wall at a second location spaced from the first location;

wherein the extension flanges include edges, each of the edges having an edge surface area, and major surfaces, each of the major surfaces having a major surface surface area, the major surface surface area being greater than the edge surface area, the major surfaces of the extension flanges being in opposed face-to-face relation and directly engaging each other along a juncture between the connection portion and the channel-shaped portion, the edges of the extension flanges being free of engagement with each other.

2. A hanger as set forth in claim 1, wherein the channel-shaped portion is disposed with respect to the extension portion to mount the structural component generally orthogonal to the wall.

3. A hanger as set forth in claim 1, wherein the channel-shaped portion is disposed with respect to the extension portion to mount the structural component at a non-orthogonal angle relative to the wall.

4. A hanger as set forth in claim 1, wherein the major surfaces of the extension flanges are configured to engage each other along a juncture positioned within the sheathing.

5. A hanger as set forth in claim 1, wherein each of the extension flanges includes a driving point configured to be inserted into the sheathing, the driving point extending vertically when the hanger is attached to the wall.

6. A hanger as set forth in claim 1, wherein the connection portion includes connector tabs configured to overlie and engage a top plate of the wall.

7. A hanger as set forth in claim 1, wherein the extension portion includes back flanges configured to engage the wall at said first location.

8. A hanger as set forth in claim 1, wherein the channel-shaped portion includes a base sized and shaped for receiving the structural component thereon and side panels extending upward from the base, each of the side panels including fastening structure for use in attaching the hanger to the structural component.

9. A hanger as set forth in claim 8, wherein the channel-shaped portion further includes back panels, each of the back panels extending from a respective one of the side panels.

10. A hanger as set forth in claim 1 in combination with a slot template for cutting a slot in the sheathing configured to receive the extension portion of the hanger.

11. A hanger as set forth in claim 1, wherein the channel-shaped portion, extension portion, and connection portion are formed as a one-piece construction such that the channel-shaped portion is fixed in position relative to the connection portion.

12. A hanger as set forth in claim 1 wherein the channel-shaped portion includes a base sized and shaped for receiving the structural component thereon and side panels extending upward from the base, the extension flanges being substantially perpendicular to the base.

13. A hanger as set forth in claim 12 wherein the connection portion includes connector tabs configured to overlie and engage a top plate of the wall, the connector tabs being parallel to the base, and perpendicular to the side panels and the extension flanges.

* * * * *